US006412576B1

(12) United States Patent
Meiners

(10) Patent No.: US 6,412,576 B1
(45) Date of Patent: Jul. 2, 2002

(54) METHODS AND APPARATUS FOR SUBTERRANEAN DRILLING UTILIZING A TOP DRIVE

(76) Inventor: William J. Meiners, 1702 Wirt Rd., #32, Houston, TX (US) 77055

( * ) Notice: Subject to any disclaimer, the term of this patent is extended or adjusted under 35 U.S.C. 154(b) by 27 days.

(21) Appl. No.: 09/599,705

(22) Filed: Jun. 22, 2000

Related U.S. Application Data

(60) Provisional application No. 60/159,914, filed on Oct. 16, 1999.

(51) Int. Cl.[7] ..... E21B 3/00

(52) U.S. Cl. ..... 175/57; 175/170; 175/85; 113/141

(58) Field of Search ..... 175/85, 170, 195, 175/57; 173/141, 163, 164

(56) References Cited

U.S. PATENT DOCUMENTS

| | | | | |
|---|---|---|---|---|
| 4,437,524 A | | 3/1984 | Boyadjieff | 173/43 |
| 4,449,596 A | | 5/1984 | Boyadjieff | 175/85 |
| 4,458,768 A | | 7/1984 | Boyadjieff | 175/85 |
| 4,529,045 A | * | 7/1985 | Boyadjieff et al. | 173/164 |
| 4,605,077 A | | 8/1986 | Boyadjieff | 175/85 |
| 4,625,796 A | | 12/1986 | Boyadjieff | 166/77.5 |
| 4,667,752 A | | 5/1987 | Berry | 175/85 |
| 4,865,135 A | * | 9/1989 | Moses | 175/57 |
| 5,501,286 A | | 3/1996 | Berry | 175/52 |
| 5,755,296 A | | 5/1998 | Richardson | 175/162 |

OTHER PUBLICATIONS

Economic/Operational Advantages of Top Drive Installations Author: Michael Brouse Reprinted from Oct. 1996 "World Oil".

* cited by examiner

*Primary Examiner*—William Neuder
(74) *Attorney, Agent, or Firm*—Gilbreth & Associates, P.C.

(57) ABSTRACT

Apparatus and methods for a top drive unit for drilling of hydrocarbon wells, with the top drive including a channel or passage allowing for passage of drill pipe through the top drive to provide ease of operation during drilling operations. With this passage, drill pipe may be passed through the top drive instead of moving the unit aside as is required with conventional top drives.

12 Claims, 30 Drawing Sheets

METHODS AND APPARATUS FOR SUBTERRANEAN DRILLING UTILIZING A TOP DRIVE

REFERENCE TO RELATED APPLICATIONS

This patent application claims benefit of the filing date of United States Provisional Patent Application Serial No. 60/159,914, filed Oct. 16, 1999, entitled "An Improved Top Drive Design and Drilling System," incorporated herein by reference.

BACKGROUND OF THE INVENTION

1. Field of the Invention

The present invention relates to methods and apparatus for drilling into the subterranean, and to methods for modifying drilling equipment. In another aspect, the present invention relates to methods and apparatus for drilling for hydrocarbons, and to methods for modifying existing hydrocarbon drilling equipment. In even another aspect, the present invention relates to top drive drilling apparatus. In even another aspect, the present invention relates to an improved top drive having a passage through which may be passed drilling tubulars, and to methods of drilling utilizing such a top drive that allows for passage of drilling tubulars through the top drive without moving the top drive aside, thus providing for increased efficiency and safety in handling drilling tubulars. In addition, the present invention relates to methods of modifying existing drilling equipment to utilize such a top drive.

2. Description of the Related Art

Until recent times, conventional well drilling systems most commonly utilized a rotary table drilling system requiring the use of a rotary table, kelly and kelly bushing.

In such conventional drilling systems, the drill pipe string, an assembly or "string" of drill pipe connected to the drill bit at one end, is rotated in the well bore by a kelly connected at the other end. The kelly is rotated by a rotary table.

In operation, once rotary table drilling has advanced one pipe length, drilling is halted, the pipe string is de-coupled from the kelly, another pipe length is added to the pipe string, the string is re-coupled to the kelly, and then drilling is resumed.

Thus, one limitation of rotary table drilling is that it only allows for drilling in increments of single pipe lengths (approximately 31 feet/9.4 meters).

The top drive drilling unit was developed to overcome this single pipe length limitation, and allows for drilling an entire stand of drill pipe, which consists of a multiple of single lengths of drill pipe connected together. Typically stands consists of three pipe lengths (approximately 93 feet/28.3 meters). Essentially, the top drive rotates the drill string from the top of the string as opposed to earlier methods of drilling with a rotary table and kelly at the rig floor.

While the concept of using a top drive unit, also referred to as overhead rotary drilling, derrick drillers, and overhead power swivels, on drilling rigs dates back to the 1920's, practical systems date only from the 1980's. Many of the early conventional top drive units suffer from an inability to efficiently handle drilling tubulars (pipe or tubing). Specifically, many conventional top drive units cannot easily or efficiently accommodate connection and disconnection of pipe lengths, and the moving and handling of stands of drill pipe.

It was in the 1980's that commercial top drive systems complete with pipe handler (breakout wrench, lift tilt, over-drill provisions and inside well control) were developed that overcame some of the previous limitations. These systems allowed for continuous drilling of stands of drill pipe, and for circulating and reaming the hole during the procedures of tripping in and tripping out.

However, when adding a new stand of drill pipe by use of many presently available conventional top drive systems, it is necessary for the top drive to break out of the drill string, and tilt out to align and stab the stand of drill pipe in the mouse hole. This "tilting out" causes the stand of drill pipe, to sway when the stand of pipe is lifted. The swaying movement is unsafe and can cause injury or damage if not controlled.

In a conventional tripping out cycle, an elevator attached to a top drive unit is lowered and attached to the top of the drill string. The drill string is raised up so that the stand of pipe to be broken out is above the rig floor and slips are set to secure the string. After a break out tool breaks out the stand of pipe, the top drive elevator must then hand off, or transfer, the stand of pipe to a derrick hand or a mechanical pipe handler for racking the stand in the derrick. There are many conventional techniques and methods for doing this step, yet these methods are generally awkward since the conventional top drive unit blocks access to the stand from above, thus not allowing supporting and lifting the stand from above. Due to the awkwardness of transferring the stand of pipe, this step can be dangerous and unsafe if the transfer is not carried out in a skillful and careful manner. Only after the drive elevator transfers the stand of drill pipe is the conventional top drive unit available to be lowered back down to the drill floor.

The art is crowded with patents relating to drilling of wells.

U.S. Pat. No. 4,437,524 issued Mar. 20, 1984, to Boyadjieff et al, discloses a well drilling apparatus designed to eliminate the need for a rotary table, kelly and kelly bushing, and includes a drilling unit which is shiftable between a drilling position in vertical alignment with a mousehole, and an inactive position.

U.S. Pat. No. 4,449,596 issued May 22, 1984, to Boyadjieff, discloses a top drive well drilling system that includes pipe handling equipment that facilitates the making and breaking of connections to the drill string during the drilling cycle.

U.S. Pat. No. 4,458,768 issued Jul. 10, 1984, to Boyadjieff, discloses a top drive well drilling system having a drilling unit shiftable to various positions, wherein the shifting movement is accomplished by means of a structure that guides the unit for movement along predetermined paths.

U.S. Pat. No. 4,605,077 issued Aug. 12, 1986, to Boyadjieff, discloses a top drive drilling system having a motor which is connected to the upper end of the drill string and moves upwardly and downwardly therewith.

U.S. Pat. No. 4,625,796 issued Dec. 2, 1986, to Boyadjieff, discloses an apparatus comprising a stabbing guide and a back-up tool, wherein the apparatus can function in aligning an additional length of pipe with the upper end of the drill string and thereby facilitates the controlled stabbing of pipe length for addition into the top of a drill string.

U.S. Pat. No. 4,667,752 issued May 26, 1987, to Berry et al, discloses a top head drive well drilling apparatus with a wrench assembly and a stabbing guide, wherein the wrench assembly is mounted on the drive unit and the stabbing guide is mounted on the wrench assembly.

U.S. Pat. No. 5,501,286 issued Mar. 26 1996, entitled to Berry, discloses and apparatus and method for displacing the lower end of a top drive torque track suspended from a derrick wherein a drive unit is disconnected from the drill string and suspended from the torque track. The top drive suspended from the torque track can then be moved away so as not to interfere with the addition or removal of drill string sections.

U.S. Pat. No. 5,755,296 issued May 26, 1998, to Richardson et al, discloses a portable top drive comprising a self-contained assembly of components necessary to quickly install and remove a torque guide and attendant top drive unit in a drilling rig mast.

In spite of the numerous modifications made in drilling apparatus, the current methods and apparatus for drilling and handling drill pipe are still awkward and many of the systems require that the top drive unit, or a portion thereof, tilt out for connecting to the next stand of drill pipe, as well as special methods or mechanisms for the top drive unit, or a portion thereof, to tilt out.

Due to the awkwardness and the manner in which drilling tubulars are handled there exists a need for a safer way to handle drilling tubulars when drilling and tripping.

Also, a significant amount of time is needed to handle stands of pipe when drilling and tripping. More efficient methods of handling drilling tubulars during drilling and tripping would also lower overall drilling costs.

Thus, there exists a need in the art for methods and apparatus for drilling the subterranean, and to methods and apparatus for modification of existing drilling equipment.

There exists another need in the art for methods and apparatus for drilling hydrocarbon wells, and to methods and apparatus for modification of existing hydrocarbon well drilling equipment.

There exists even another need in the art for improved methods and apparatus for drilling hydrocarbon wells.

There exists still another need in the art for improved methods and apparatus for drilling hydrocarbon wells that overcome one or more of the deficiencies of the prior art.

There exists yet another need in the art for methods and apparatus for drilling wells, not requiring tilt out of the top drive unit to connect to the next stand of pipe.

There exists still another need in the art for methods and apparatus for drilling wells, that provides for increased safety for operators and workers when drilling.

There exists even still another need in the art for methods and apparatus for drilling wells, that reduces the amount of time devoted to adding and removing stands of pipe to the drill string.

These and other needs in the art will become apparent to one of skill in the art upon review of the specification, including the drawings and claims.

SUMMARY OF THE INVENTION

It is an object of the present invention to provide for methods and apparatus for drilling the subterranean, and to methods and apparatus for modification of existing drilling equipment.

It is another object of the present invention to provide for drilling hydrocarbon wells, and to methods and apparatus for modification of existing hydrocarbon well drilling equipment.

It is even another object of the present invention to provide for improved methods and apparatus for drilling hydrocarbon wells.

It is still another object of the present invention to provide for improved methods and apparatus for drilling wells, which overcome one or more of the deficiencies of the prior art.

It is yet another object of the present invention to provide for drilling wells, not requiring tilt out of the top drive unit to connect the next stand of pipe.

It is also another object of the present invention to provide for drilling wells, that provides for increased safety for operators and workers when drilling.

It is even another object of the present invention to provide for drilling wells, that reduces the amount of time devoted to adding and removing stands of pipe to the drill string.

These and other objects of the present invention will become apparent to one of skill in the art upon review of the specification, including the drawings and claims.

Specifically, one or more of the following embodiments or other possible embodiments of the present invention are believed to represent an advancement in the art and/or are believed overcome one or more of the disadvantages of current drilling systems and provide a top drive system that (1) is more simple and safe than conventional systems; (2) reduces the awkwardness of handling drill pipe; (3) eliminates the need for a top drive unit to tilt out; (4) reduces the time required for the tripping in cycle; (5) reduces the time required for the tripping out cycle; and/or (6) reduces the total time required for the drilling procedure.

According to one embodiment of the present invention there is provided a drilling apparatus. The drilling apparatus comprises a main body structure or top drive and a drill string drive mechanism. Extending vertically through the main body structure is a main body passage. Positioned within the main body passage is the drill string drive mechanism which is rotatable in relation to the main body. Extending through the drive mechanism is a mechanism passage which is adapted to allow travel of drilling tubulars through the passageway. The drive mechanism is also adapted to be driven by a motor or plurality of motors and is further adapted to drive a drill string.

According to another embodiment of the present invention there is provided a drilling apparatus comprising a vertically extending tower that supports a main body structure having a main body passage extending therethrough. The main body comprises a drill string drive mechanism that is rotatably positioned within the main body passage and is rotatable in relation to the main body. Extending through the drill string drive mechanism is a mechanism passage adapted to allow travel of drilling tubulars through the passageway. The drive mechanism is adapted to be driven by a motor or plurality of motors, and is also adapted to drive a drill string.

According to even another embodiment of the present invention there is provided a drilling apparatus comprising a hollow core stem which has a first end, a second end, and a connecting member. The connection member is positioned between the first and second ends, and is adapted for connection to a drive mechanism. The first end of the core stem is adapted for connection to a drill string, while the second end is adapted for connection to a mud line assembly.

According to still another embodiment of the present invention there is provided a drilling apparatus comprising a vertically extending tower supporting a main body. Positioned to the main body is a drill string drive mechanism that is rotatable by one or more motors. Extending through the drill string drive mechanism and the main body structure is a main body passage. Positioned in the mechanism passage is a hollow core stem (which is removable or moveable from the main body passage) comprising a connecting member which rotatably connects the core stem to the drive mechanism. The mechanism passage can be adapted to allow travel of drill pipe therethough by moving or removing the hollow core stem from the mechanism passageway. The core stem further comprises a first end which extends into the mechanism passage and is positioned for connection to a drill string, and a second end adapted for connection to a mud line assembly. Also provided is an auxiliary hoisting system for handling and racking drilling tubulars, and a main hoisting system for providing vertical movement of the main body in relation to the tower.

According to yet another embodiment to the present invention there is provided a well drilling apparatus comprising a top drive assembly, a drilling fluid line assembly, and a hollow core stem. The top drive assembly comprises a main body defining a main body passage extending therethrough, and a drive mechanism defining a drive mechanism passage through the main body passage, wherein the drive mechanism is rotatably positioned within the main body passage, and wherein the drive mechanism passage is adapted to allow travel of drill pipe therethough. The drilling fluid line assembly comprises a drilling fluid line connector. The hollow core stem defines a core stem passage therethough, and is removably positioned within the drive mechanism passage. The core stem comprises a first end which extends into the drive mechanism passage and is adapted for connection to a drill string, and a second end which is connected to the drilling fluid line connector. In a preferred embodiment, the second end of the core stem and the drilling fluid line connector are rotatable relative to each other. In a more preferred embodiment, the second end of the core stem swivels in relation to the drilling fluid line connector. In addition, the core stem is adapted to be rotated by the drive mechanism and to drive rotation of the drill string.

According to even still another embodiment of the present invention there is provided a method of preparing drill pipe or a stand of pipe for a drilling operation comprising the step of connecting a drill pipe or stand of pipe to a hollow core stem. The hollow core stem comprises a connecting member adapted for connecting the core stem to a drive mechanism, a first end adapted for connection to a drill string, and a second end adapted or connection to a mud line assembly.

According to even yet another embodiment of the present invention there is provided a method for drilling a well comprising a first step of passing a drill pipe through a mechanism passage of a drilling apparatus. The drilling apparatus comprises a main body and a drill string drive mechanism. Extending through the main body is a main body passage in which there is rotatably positioned a drill string drive mechanism which is rotatable in relation to the main body. The drive mechanism has a mechanism passage extending through it that is adapted to allow travel of drilling tubulars therethrough. The drive mechanism is adapted to be driven by a motor or plurality of motors. The drive mechanism is also adapted to connect and drive the hollow core stem and the hollow core stem is adapted to connect to and drive the drill string. The method further comprises the steps of connecting drill pipe to the drill string, connecting the drill string to the drive mechanism, rotating the drill string into the well hole, and disconnecting the drill string and the drive mechanism.

According to still yet another embodiment of the present invention there is provided a method of disconnecting a portion of a drill string positioned in a well bore. The drill string has at least two portions of drill pipe positioned in the well bore. The method comprises lifting a portion of drill string from the well bore, passing the portion through a passage extending through a main body or top drive, and disconnecting the portion from the drill string.

According to even yet another embodiment of the present invention there is provided a method for adding drill pipe to a drill string. The method comprises passing drill pipe or stand of pipe to be added to the drill string through a passage extending through a main body or top drive, and connecting the drill pipe to the drill string.

According to yet even still another embodiment of the present invention there is provided a well drilling apparatus comprising a top drive assembly, a moveable part, a drilling fluid line and a drill string. The top drive assembly defines a top drive assembly passage extending therethrough, wherein said top drive assembly passage is adapted to allow travel of drill pipe therethrough. The moveable part is removably positioned within said top drive assembly passage, wherein said moveable part comprises a first end and a second end, and wherein said moveable part is rotatable by said top drive. The drilling fluid line is connected to said first end of said moveable part and the drill string is connected to said second end of said moveable part, wherein rotation of said moveable part by said top drive drives rotation of said drill string.

According to even still yet another embodiment of the present invention there is provided a method for modifying a drilling apparatus. The apparatus comprises a tower supporting a top drive through which drill pipe cannot pass. The method comprises removing the top drive from the tower, and placing a second top drive on the tower. Extending through the second top drive is passage through which drilling tubulars can be passed.

These and other embodiments of the present invention will become apparent to those of skill in the art upon review of this specification, including its drawings and claims.

BRIEF DESCRIPTION OF THE DRAWINGS

Throughout the following figures, like reference numbers represent like members.

DETAILED DESCRIPTION OF THE INVENTION

Figure 1:
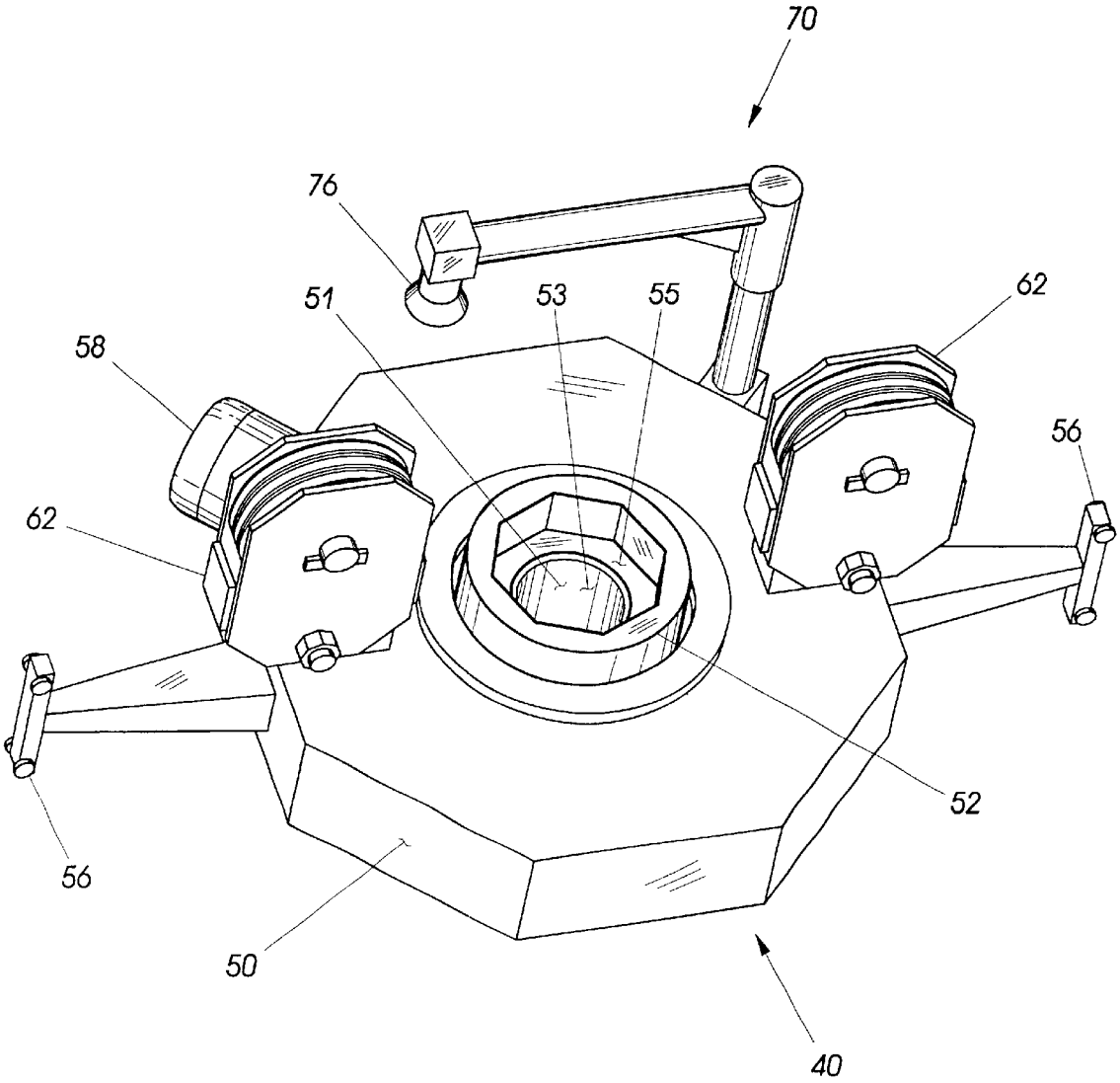
FIG. 1 is a perspective view of one embodiment of a top drive of the present invention.

The present invention is directed to an innovative rotary top drive and an improved drilling system. (Top drives are also known in the art as: overhead rotary drilling systems, derrick drillers, and overhead power swivels. In this specification the term top drive is synonymous with all of these terms). In contrast to conventional top drive units which lack a passage or hole through which objects such as drill string or stand of drill pipe can be passed, the top drive of the present invention comprises a visible linear passage or hole through the center of the top drive (a non-limiting example of which includes a ring-shaped top drive) through which physical objects such as, for example, the drill string or a stand of drill pipe can pass.

Although the illustrated embodiment comprises a top drive defining an elongated tubular passage extending therethrough, and a drive mechanism defining an elongated tubular passage therethrough, it should be understood that the passage can be any shape so long as linear objects such as drill pipe can be passed therethrough.

A drilling operation of one embodiment of the present invention includes: drilling is halted and the mud flow is ceased; the slips are set to hold the drill string; the mud line assembly is disconnected from the core stem in the top drive unit; the core stem is broken out of the drill string; the core stem is removed from the main passageway in the top drive; a stand of drill pipe previously made up to a second core stem is lowered through the hole or mechanism passage of the top drive unit while the top drive unit is simultaneously being raised up the stand of drill pipe; the stand of drill pipe is made up to the drill string; the top drive unit engages the second core stem; the mud line assembly is reconnected to the second core stem; the slips are removed and drilling resumes.

A tripping out operation of one embodiment of the present invention involves: the elevator on the top drive unit raises the drill string to the proper height to trip out a stand of drill pipe and the slips are set; the top drive unit is then lowered to the drill floor with the drill string passing through the main passageway in the top drive; a pipe handling mechanism connects to the top of the drill string; by the time the top drive unit reaches the drill floor, the stand of pipe has already been broken out of the drill string and is being racked in the fingerboard; once the top drive unit reaches the drill floor, the drill string can again be raised, lowered, raised, lowered, etc., without having to wait at the top and bottom positions, as is the case with conventional tripping out procedures.

The tripping out procedure of the present invention reduces the time involved in the procedure. Generally, there are three events or steps that are usually required in regard to tripping out stands of drill pipe: A) a break out tool must break out the stand of drill pipe; B) the stand of drill pipe must be handed off and racked in the derrick; and C) the top drive unit must travel back down to the drill floor for the next stand of drill pipe. Using the present invention, events A and C can be conducted simultaneously and events B and C can be conducted simultaneously, whereas when tripping out with conventional top drive systems, events A, B, and C must happen sequentially.

Regarding tripping in procedures, there generally are three events or steps that are usually required in regard to tripping in stands of drill pipe and are as follows: A) the top drive unit must be raised to the top of the derrick; B) the stand of drill pipe being added must be retrieved from the stand rack in the derrick and moved to a position in alignment with the drill string and well hole; and C) the make up tool must make up the connection between the new stand of pipe and the drill string. Using the present invention, preferably two or more of events A, B and C are preferably conducted simultaneously, most preferably, all three events are conducted simultaneously.

Figure 2:
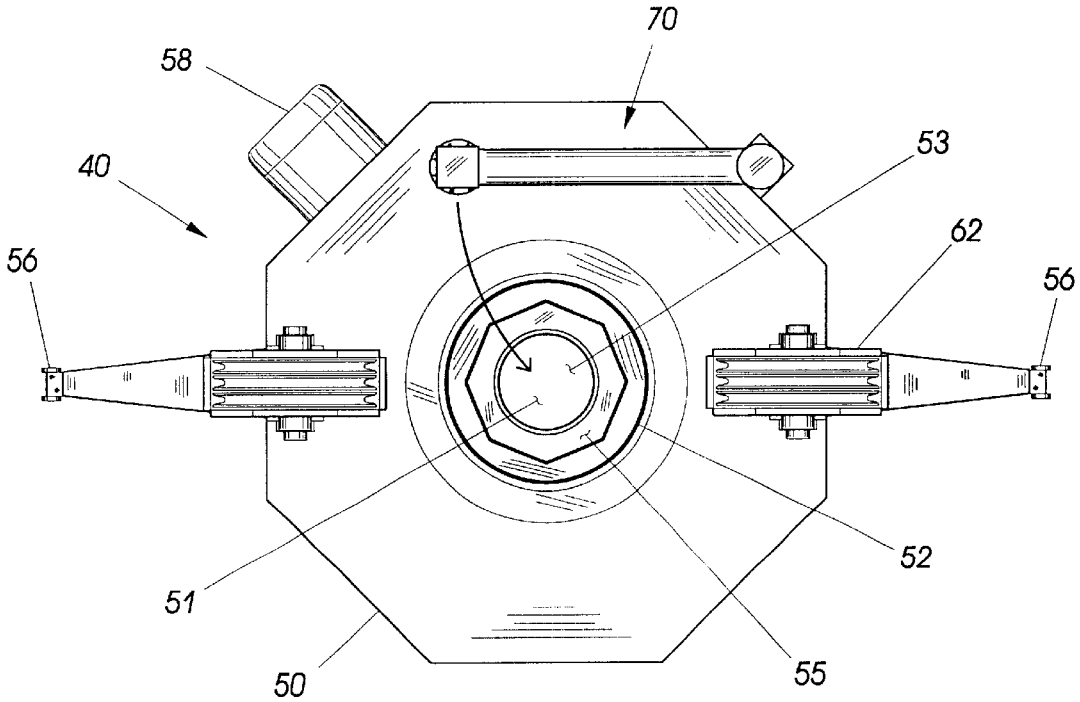
FIG. 2 is a top view of the top drive of FIG. 1.
Figure 3:
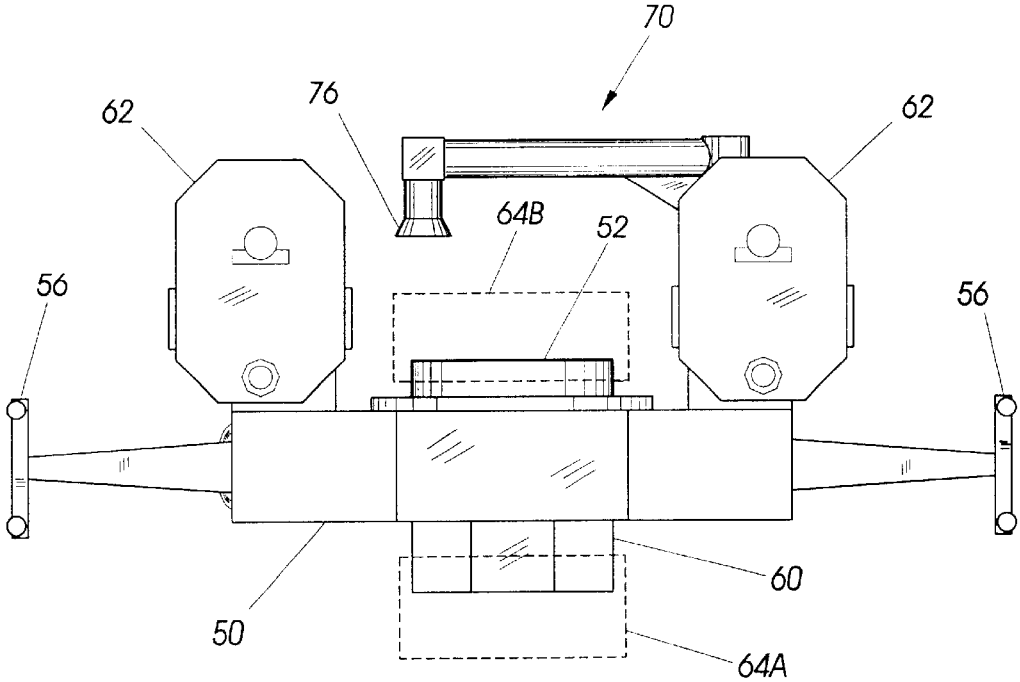
FIG. 3 is a front view of the top drive of FIG. 1.

Referring now to FIGS. 1, 2, and 3, there is shown perspective, top and front views, respectively, of one embodiment of the present invention. While the top drive embodiment depicted in FIGS. 1–3 is O-shaped or ring-shaped, this is not intended to exclude embodiments having other shapes. It should also be understood the passage or channel for passing drilling tubulars there through, may or may not be fully enclosed. For example, non-limiting examples of top drive shapes defining open channels include C-shaped or U-shaped embodiments, which operate in a similar manner to the O-shaped embodiment.

Referring now to FIGS. 1–3, top drive 40 comprises a main body structure 50 defining a main body passage 51 extending therethough. Main body structure 50 further comprises a drive mechanism 52 positioned within main body passage 51. Drive mechanism 52 has drive mechanism passage 53 extending therethrough.

Main body structure 50 of top drive 40 may further comprise a motor 58 by which drive mechanism 52 is powered. Motors are known to those in the art and the present invention is not limited to a specific type of motor known now or in the future. This invention is also not limited to a single motor, as a plurality of motors may also be used. Motor 58 may be connected to drive mechanism 52 by a transmission means such as, for example, gearing, chain, or belts. The transmission may be located within main body structure 50. It should be noted that transmissions or means to couple and connect motors to drive mechanisms to provide torque and rotation are known to those in the art and the present invention is not limited to a specific type of transmission.

Top drive 40 further comprises mud line connection piping 70. As known in the art, mud is a drilling fluid that is pumped into the well bore to aid in removal of cuttings. Mud-line connection piping 70 may receive mud or drilling fluid from a mud pump by means, such as, for example, through the standpipe and rotary hose). Although mud line connection piping 70 is shown mounted to the exterior side surface, it should be understood that mud line piping 70 can be mounted at any location so long as drilling fluid can be properly supplied for the drilling process. The operation of mud line connection piping 70 will be discussed in more detail below.

Top drive 40 further comprises two guide and counter-torque arms 54 and guide trolleys 56. The purpose of guide and counter-torque arms 54 and guide trolleys 56 are for positioning and guiding top drive 40 during vertical movement, and also for resisting the counter-torque produced when top drive 40 is rotating and drilling. While this embodiment depicts two arms, it is possible for the top drive to comprise one or any number of arms or extensions and guide trolleys to guide and resist the counter-torque of top drive 40. Guide and counter-torque arms or methods for positioning, guiding, and resisting counter-torque for top drives are known to those in the art and the present invention is not limited to a specific type of positioning, guiding, and resisting counter-torque known now or in the future.

Top drive 40 also comprises a means for raising and lowering top drive 40 in a derrick or mast structure. This may be accomplished by use of two sheave blocks 62, as depicted in FIG. 1. Conventional terminology refers to this two sheave block arrangement as a split traveling block. However, the methods and apparatus for raising and lowering an object such as a top drive in a derrick or mast type structure are known to those in the art, such as, for example, hydraulic cylinders or single wirelines. The present invention is not limited to a specific apparatus or method for raising and lowering the top drive, and requires only that the space directly above the drill string is not obstructed.

FIG. 1 also depicts traveling blocks 62 connected to top drive 40 by a single bolt or pin type of connection. Methods to mechanically connect objects are known to those in the art and the present invention is not limited to a specific method or type of connection; i.e., bolting, welding, pinning etc. Another embodiment of the present invention could be an integral arrangement of the sheaves within the main body structure 50.

Figure 4:
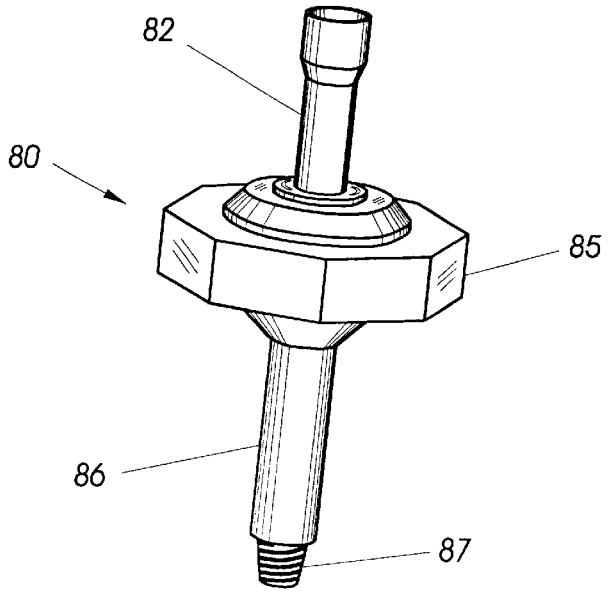
FIG. 4 is a perspective view of one embodiment of a core stem of the present invention.

Shown in FIG. 4 is a core stem 80 of the present invention which fits into the mechanism passage 51 or hole, of drive mechanism 52 of top drive 40. Core stem 80 comprises a first end or upper part 82, a connecting or middle part 85, and a second end or lower part 86. Preferably, the upper part 82 is of a shape that allows for safe and simple attachment to an auxiliary hoist elevator, or mechanical arm, for moving or removing core stem 80 from mechanism passage 53, such as, for example, the shape of the top end or "box" of a drill pipe joint.

Upper part 82 may be of any shape that allows for simple and safe attachment to an elevator, or mechanical arm, for moving or removing core stem 80 from mechanism passage 53. The design of upper part 82 also provides for upper part 82 to mate and seal with mud line connector 76. This can be a threaded-type connection similar to a drill pipe tool joint connection. It should also be understood that the present invention is not limited to specific types of mating and sealing components.

Another embodiment of the present invention is directed to a well drilling apparatus comprising a top drive assembly, a drilling fluid line assembly, and a hollow core stem. The top drive assembly comprises a main body defining a main body passage extending therethrough, and a drive mechanism defining a drive mechanism passage through the main body passage, wherein the drive mechanism is rotatably positioned within the main body passage, and wherein the drive mechanism passage is adapted to allow travel of drill pipe therethough. The drilling fluid line assembly comprises a drilling fluid line connector. The hollow core stem defines a core stem passage therethough, and is removably positioned within the drive mechanism passage. The core stem comprises a first end which extends into the drive mechanism passage and is adapted for connection to a drill string, and a second end which is connected to the drilling fluid line connector. In a preferred embodiment, the second end of the core stem and the drilling fluid line connector are rotatable relative to each other. In a more preferred embodiment, the second end of the core stem swivels in relation to the drilling fluid line connector. In addition, the core stem is adapted to be rotated by the drive mechanism and to drive rotation of the drill string.

In some embodiments of the present invention, core stem 80 remains attached to the mud line assembly. Moving or removing the core stem from the mechanism passage would be accomplished by lifting the core stem out of the mechanism passage and retracting or rotating the core stem away from the top of mechanism passage 53. The core stem would remain attached to the mud line until it is again needed to be reinserted in mechanism passage 53 for connecting to the drill string. In such an embodiment, only one core stem may be required as opposed to the two core stem embodiment described in Example 1 below.

In order to prevent rotation of the mud line assembly, upper part 82 of core stem 80 may function as a swivel allowing upper part 82 to rotate independently from the connecting middle part 85 and lower part 86. Alternatively, in some embodiments, it is possible for mud line connector 76 to attach (mate and seal) to upper part 82, wherein mud line connector 76 is rotatable in relation to the core stem thereby providing swivel via the connector as opposed to the upper part. In this embodiment the part of mud line connector 76 that is attachable to upper part 82 is free to rotate independently from the rest of mud line connector 76 and mud line connection piping 70. Thus, in this embodiment, mud line connector 76 would provide a swivel type function.

It should be noted that manual and remote shutoff valves which are standard equipment in the industry may be incorporated as part of core stem 80. Shutoff valves are standard components in the industry and the present invention is not limited by the number, location, or type of shutoff valves.

Once core stem 80 is lowered into drive mechanism passage 53 of top drive 40, middle part 85 connects to top drive 40. Due to the shape of middle part 85, core stem 80 is rotated together with drive mechanism 52 of top drive 40 when drive mechanism 52 rotates.

Figure 5:
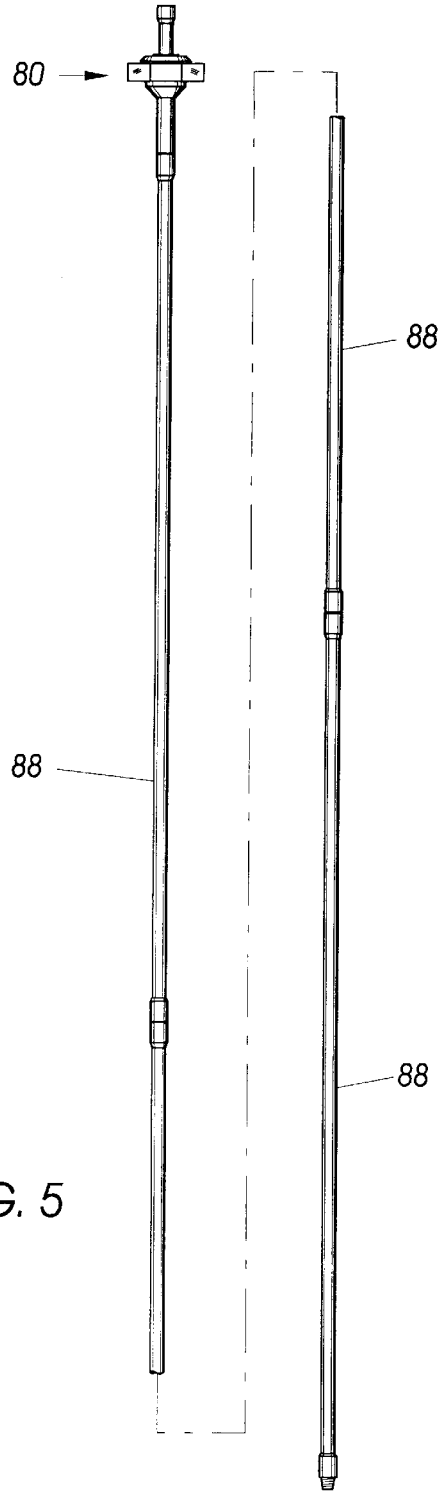
FIG. 5 is a front view of one embodiment of an assembly of the present invention comprising a core stem and a stand of drill pipe.
Figure 6:
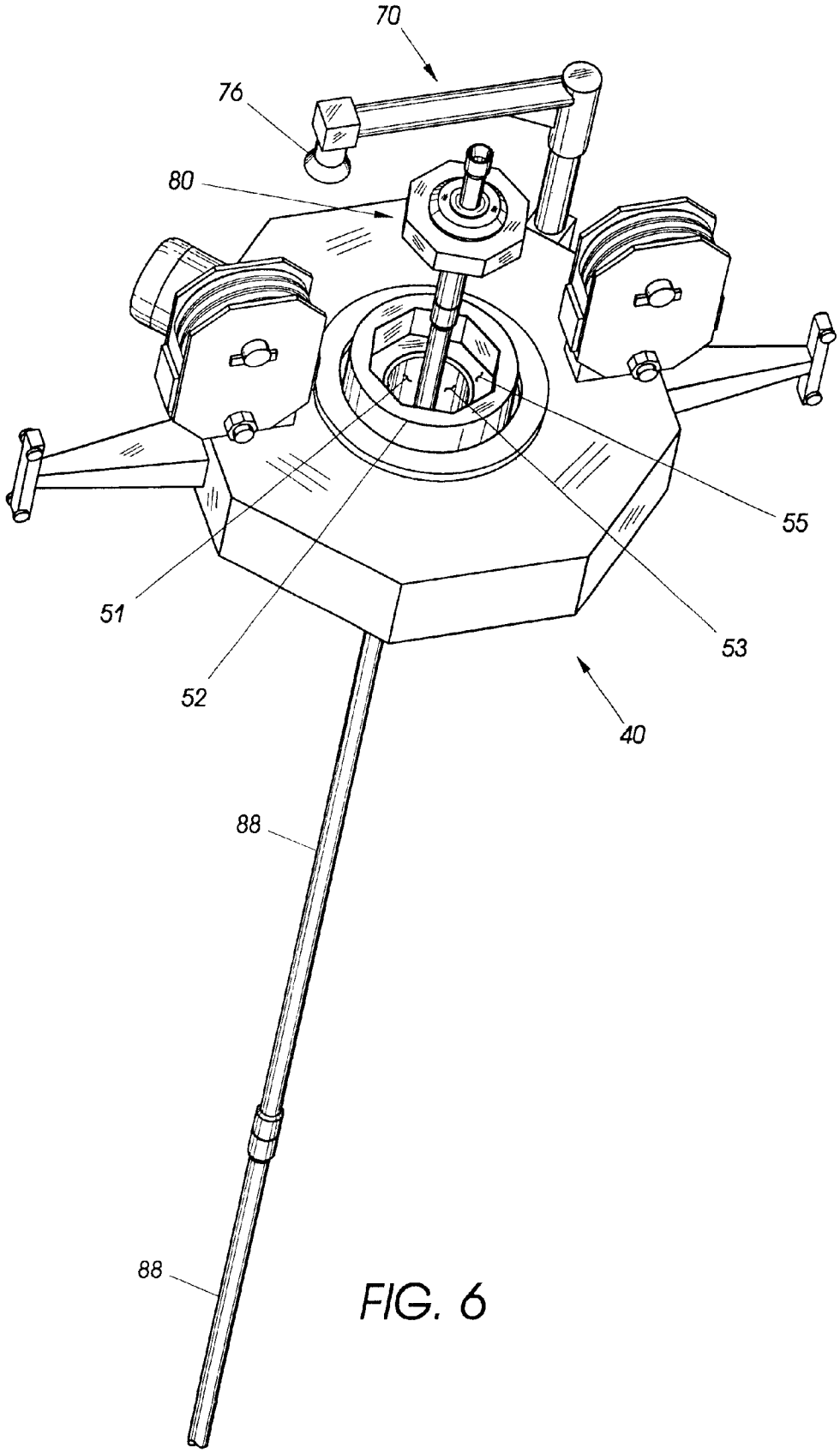
FIG. 6 is a perspective view of one embodiment of an assembly of FIG. 1 and FIG. 5.

Although middle part 85 shown in FIGS. 4–6 is octagonal in shape, any suitable regular, irregular, or curvilinear shape or perimeter is possible. In a similar manner, although the inside area of drive mechanism 52 which engages and/or surrounds middle part 85 is octagonal in shape, any suitable regular, irregular, or curvilinear shape or perimeter is possible. Non-limiting examples of such shapes include a triangle, a square, a pentagon, and a hexagon. The major requirement is that the shape of middle part 85 of core stem 80 be such that it contacts drive mechanism 52, so that middle part 85 and drive mechanism 52 rotate together. This also results in transfer of the rotational torque from drive mechanism 52 to the drill string.

Another non-limiting example that can be used to cause middle part 85 of core stem 80 to rotate as a result of rotary torque being transmitted from the top drive would be the use of pins and pin holes on the two parts which would interconnect and thereby cause the parts to rotate together.

The functions of the core stem in the drilling system of the present invention include, but are not limited to, transmitting the rotary torque from drive mechanism 52 to the drill string, and serving as a connecting link to join the mud line to the drill string.

In the embodiment shown in FIG. 6, the core stem is also utilized for supporting the weight of the drill string. This is accomplished by middle part 85 resting on ledge 55 of drive mechanism 52. It should be noted that in other embodiments of the present invention, the weight of the drill string may be supported by another component of the top drive such as an elevator or structural component located below main body structure 50, wherein the elevator or structural component supports the weight of the drill string by lifting under the top tool joint of the drill string. The elevator or structural component may also allow core stem 80 to connect to and rotate the drill string.

Core stem 80 also comprises a lower part 86 which is connectable to the top portion of a drill string. Preferably, lowermost end 87 of lower part 86 will mateably thread with the threads on the box joint on the top of a drill string. Referring now to FIG. 5 there is shown core stem 80 wherein lowermost end 87 of lower part 86 has been connected to a stand of pipe 84. Again, it should be noted that means for connecting and sealing two components or drilling tubulars together are well known to those in the art and the present invention is not limited to a specific type of connection or means for connecting and sealing core stem 80 to the drill string, stand of pipe 84 or drilling tubulars known now or in the future.

Figure 7:
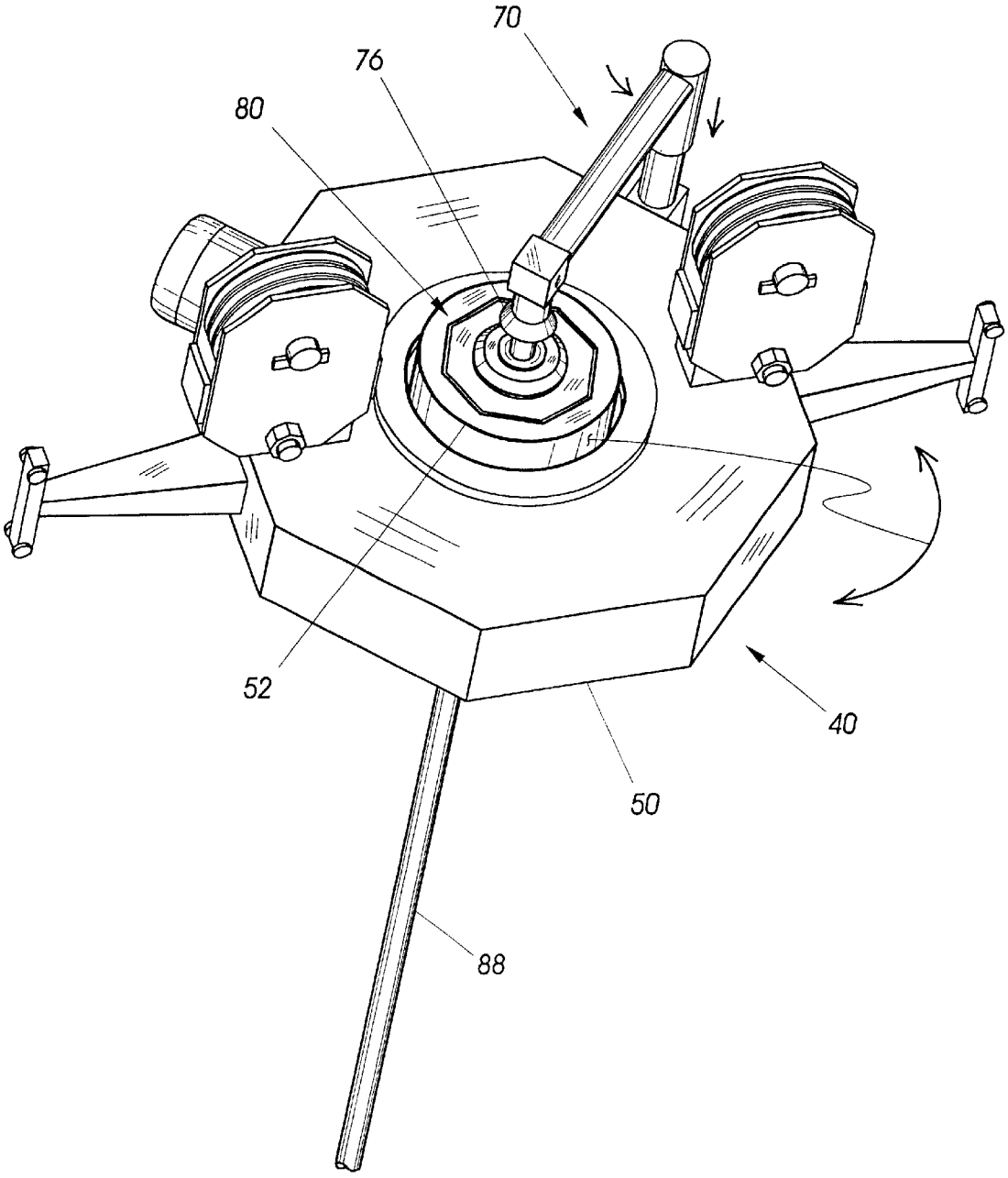
FIG. 7 is a perspective view of one embodiment of another assembly of FIG. 1 and FIG. 5.

FIG. 6 illustrates top drive 40 of the present invention with core stem 80 connected to stand of pipe 84, wherein core stem 80 is being lowered and positioned within drive mechanism passage 53. FIG. 7 illustrates top drive 40, wherein core stem 80 has been fully lowered into drive mechanism passage 53. FIG. 7 shows core stem 80 being supported by and engaged with drive mechanism 52. Also depicted in FIG. 7 is the end result of mud line connection piping 70 having been rotated over core stem 80 and mud line connector 76 lowered and connected to upper part 82 of core stem 80. These figures illustrate at least one innovative feature of the present invention wherein objects, such as drill pipe, are able to be passed through main body passage 51 of top drive 40.

One approach for maximizing the advantages of the drilling system of the present invention is through the utilization of two or more core stems 80. (However, as noted above, the present invention may be utilized with only one core stem.) For ease of manufacture and operation the two or more core stems 80 are preferably identical however, non-identical core stems 80 may be utilized provided they each suitably connect with drive mechanism 52, mud line connection piping 70, and the drill string. To differentiate between the core stems 80 in the following descriptions, one core stem is referred to as 80A and the second as 80B.

Figure 8:
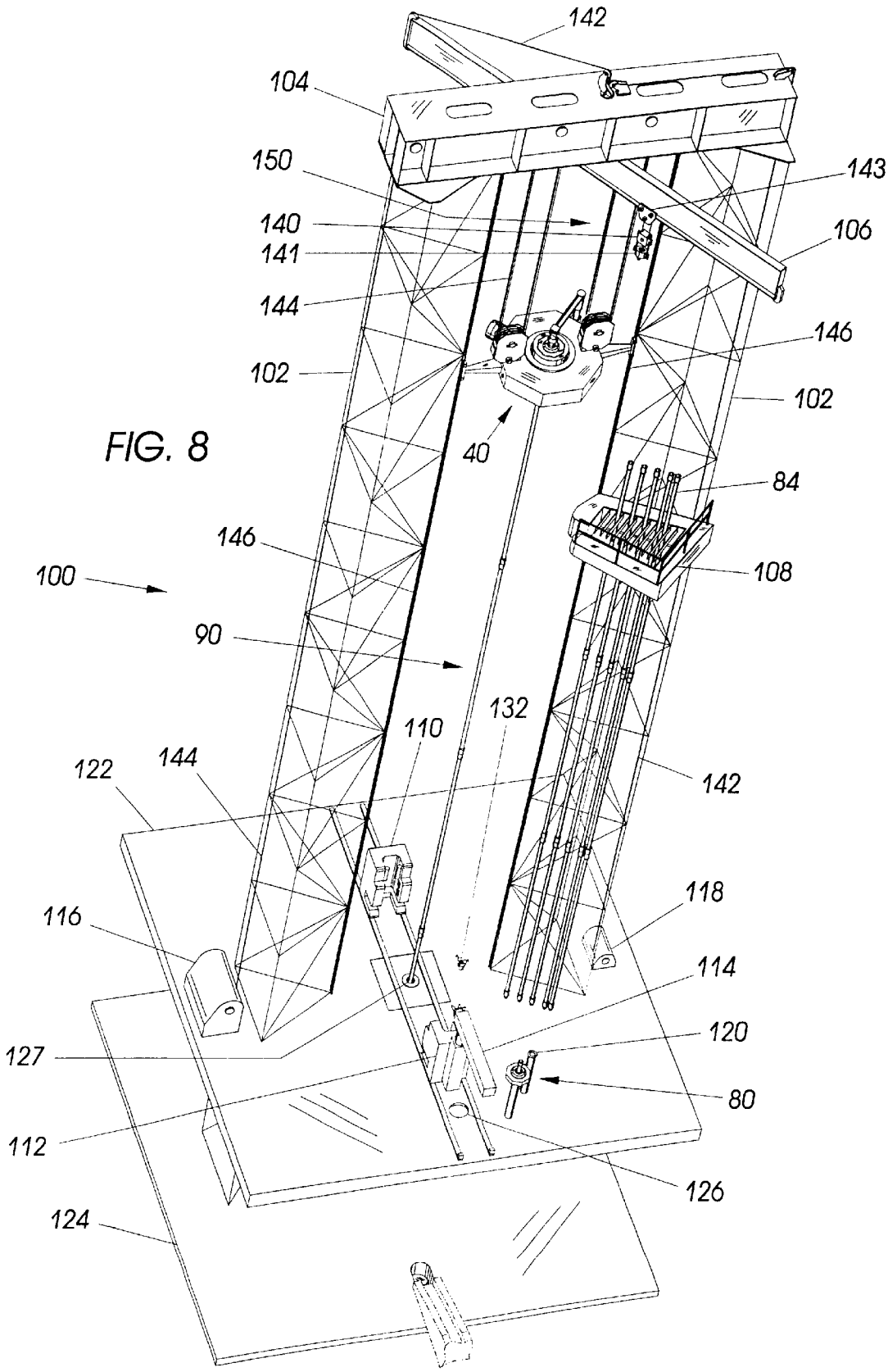
FIG. 8 is a perspective view of one embodiment of a derrick of the present invention.
Figure 9:
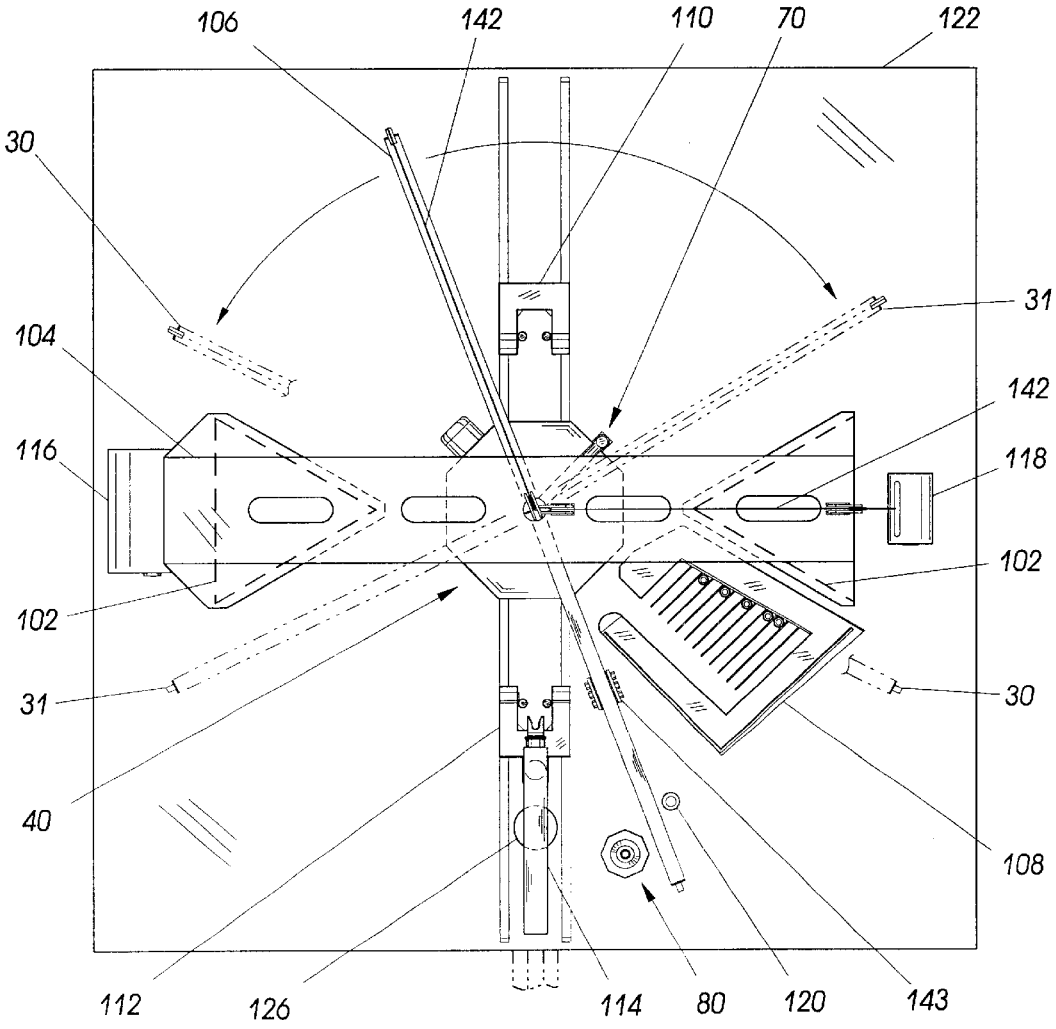
FIG. 9 is a top view of one embodiment of the derrick of FIG. 8.

Referring now to FIGS. 8 and 9, there are shown perspective and plan views, respectively, of an unconventional style drilling rig 100 of the present invention. Drilling rig 100 comprises two towers 102 which may be smaller (in width and depth) in comparison to the single, large tower of a conventional derrick. It should be understood that the present invention is not limited to the twin-tower type of derrick structure shown and can utilize all types of derrick and mast structures, including the conventional single tower structure. Also, although towers 102 in FIGS. 8 and 9 are depicted as having a triangular cross sectional shape, other tower shapes are possible such as, for example, X-shaped, I-shaped, H-shaped, cylindrical shaped, square-shaped, polygon-shaped, or any combination thereof.

In order for top drive 40 of the present invention to be used with a conventional drilling system, the existing drilling rig may need to be retrofitted or modified. The present invention also provides a method of retrofitting or modifying existing drilling rigs and equipment. Generally, modifying an existing rig using the method of the present invention comprises (1) modifying the existing crown block into a split crown block assembly, (2) providing a new or using the existing guidance and torque resisting means (such as a guide and torque track) for the top drive unit of the present invention, and (3) modify the pipe handling system of the existing rig to accommodate the new pipe handling requirements of the present invention.

Referring still to FIGS. 8 and 9, towers 102 are connected at the top by a crossover beam 104. In this embodiment crossover beam 104 also functions as the structural framework for the split crown block. The crown block sheaves are located within crossover beam 104 and therefore are not seen and thus not shown on FIG. 9.

The drilling system of the present invention requires a pipe handling system 150. Pipe handling systems handle, move, rack, and make up: joints and stands of drill pipe and tubulars. Pipe handling systems for existing conventional and non-conventional drilling rigs generally fall within three categories: (1) manual systems, (2) semi-automated, (3) fully automated. Pipe handling systems for the present invention can also fall within the same three categories.

The major components of pipe handling system 150 shown in FIG. 8 are: auxiliary hoist block 140, auxiliary hoist elevator 141, auxiliary hoist travel beam 106, auxiliary hoist winch 118, and auxiliary hoist wireline 142. Examples of pipe handling operations include, but are not limited to: handling, moving, and racking stands of pipe and drilling tubulars; and, making up and breaking down stands of pipe and drilling tubulars.

Auxiliary hoist elevator 141 is connected to auxiliary hoist block 140. Auxiliary hoist block 140 is connected to auxiliary hoist trolley 143 by means of auxiliary hoist wireline 142. Auxiliary hoist trolley 143 is mounted to and travels along the lower flange of auxiliary hoist travel beam 106. Auxiliary hoist travel beam 106 is mounted below crossover beam 104 and is capable of pivoting about the centerline of well, as indicated by dashed lines 30 and 31 in FIG. 9. Regardless of the angle of rotation of auxiliary hoist travel beam 106, auxiliary hoist block 140 can always be positioned over, or travel to, the centerline of well.

The function of auxiliary hoist elevator 141 is for safely connecting to a joint of pipe, stand of pipe, drilling tubular, or tubulars for the purpose of handling or moving the connected items. It should be understood that auxiliary hoist elevator 141 is not limited to a specific size, style, or type of elevator. It should also be understood that auxiliary hoist elevator 141 is not limited to specific mode of control, such as, manual, remote, semi-automated, or automated. Also elevators (or clamps that grip a joint of casing, tubing, drill collars, or drill pipe) are well known to those in the art and the present invention is not limited to a specific type of elevator known now or in the future.

It should also be understood that the present invention is not limited to the pipe handling system embodiment (auxiliary pipe handling system 150) depicted in FIG. 8. The present invention can work with any type and style of pipe handling system that is able to operate and work in conjunction with the top drive unit of the present invention. Pipe handling systems are well known to those in the art and the present invention is not limited to a specific type of pipe handling system known now or in the future.

At the edge of each tower 102 that is closest to well hole 127 is a guide track 146 that runs from the rig floor 122 to crossover beam 104 located at the top of the towers. A guide trolley 56 runs in each track to position, guide, and to resist the re-active counter-torque of top drive 40 during drilling procedures. While this embodiment depicts two guide tracks, it is possible for the derrick structure and drilling system to comprise just one or any number of guide tracks. Also means to guide, position, and resist the counter-torque of the top drive are known to those in the art and the present invention is not limited to a specific type or means of guiding, positioning, and resisting the counter-torque of the top drive known now or in the future.

Still referring to FIG. 8, slips 132 are for holding drill string 90 while making and breaking drill string pipe connections. Core stem stands 120 are for holding core stem 80 when it is not in use. Fingerboard stand rack 108 is for holding stands of pipe 84. A lower level 124 is the level below rig floor 122 and on land rigs would generally be the ground level. Mechanical arm 114 is for moving and handling core stem 80. Drawworks 116 is for vertically raising and lowering top drive 40 by means of wireline 144.

With core stem 80 lowered and positioned in drive mechanism 52 as shown in FIG. 7, and with mud line connection piping 70 connected to core stem 80 as shown, top drive 40 is able to function and operate in the same manner and with the same methods and parameters as existing conventional top drive units and systems. Non-limiting examples of drilling parameters include the type of drill bit, the rotational speed of the drill string, the weight on the drill bit, the drilling fluid or mud composition, mud flow, and mud pressure.

Also with the present invention, it should be noted that drilling could be conducted during the entire procedure of making up a stand of pipe 84. As another advantage, while the top drive of the present invention is being raised, the new stand of pipe 84 is being lowered through drive mechanism passage 53 of the top drive unit, and then stabbed and made up to the drill string. As a result, the top drive unit and drilling system of the present invention decreases the time involved in, and simplifies, the addition of a stand of pipe to a drill string over conventional top drive units and drilling systems.

Again, it should be understood that the embodiment of the present invention that is shown by the drawings is but one of many possible embodiments. It should also be understood that the embodiments shown in the drawings and examples were picked as the best embodiment(s) to illustrate and specify the present invention and its benefits. It should also be understood that it is not the intent for the drawings and this specifications to be a complete detailed specification of a total drilling is system. Detailed drilling information is well known to those in the art and it is given in this specification only to the extent that is necessary and helpful in understanding what the present invention is and the benefits and advantages of the present invention.

All references cited herein, including all U.S. and foreign patents and patent applications, are specifically and entirely incorporated by reference.

EXAMPLES

The following non-limiting examples are provided merely to illustrate selected embodiments of the present invention, and do not limit the scope of the claims. Please note that the these Examples are not working examples, but rather are prophetic examples and anticipate the manner in which the present invention would be operated and utilized.

Example 1

Drilling Procedure

Referring now to FIGS. 10–19 there is illustrated a drilling procedure of the present invention.

Figure 10:
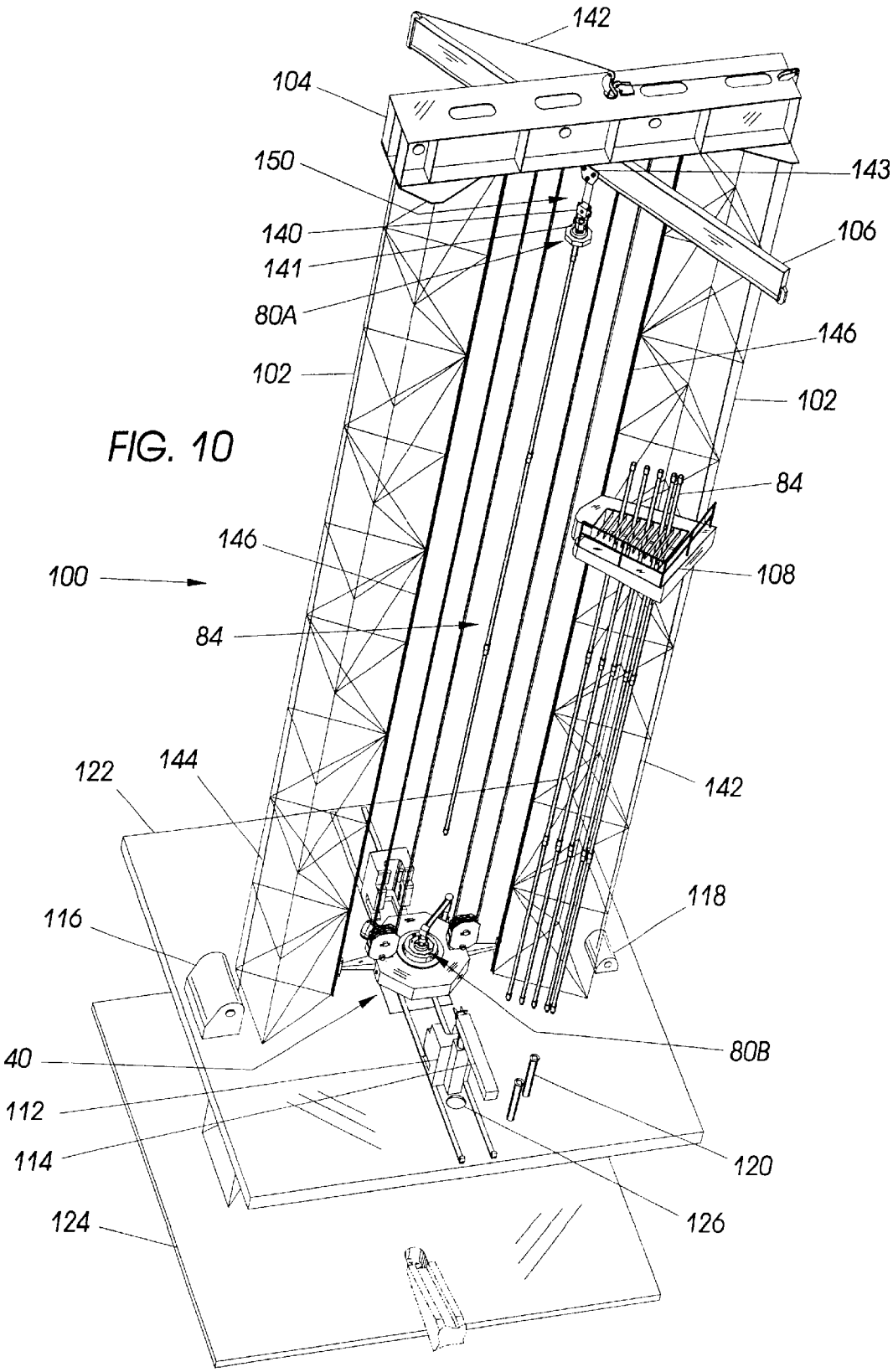
FIGS. 10–19 are a depiction of one embodiment of the drilling method of the present invention.

FIG. 10 shows top drive 40 at a phase in the drilling cycle wherein drill string 90 has been drilled down, top drive 40 is in proximity to drill floor 122, and new stand of pipe 84, needs to be added to drill string 90. One of the at least two core stems of the present invention, core stem 80A, has already been removed from core stem stand 120. Core stem 80A has been made up, or threaded on and properly torqued, to the top tool joint of a stand of drill pipe 84. Auxiliary hoist elevator 141 has already lifted core stem 80A and stand of pipe 84 to a position directly over top drive 40 and in alignment with the well hole 127.

Figure 11:
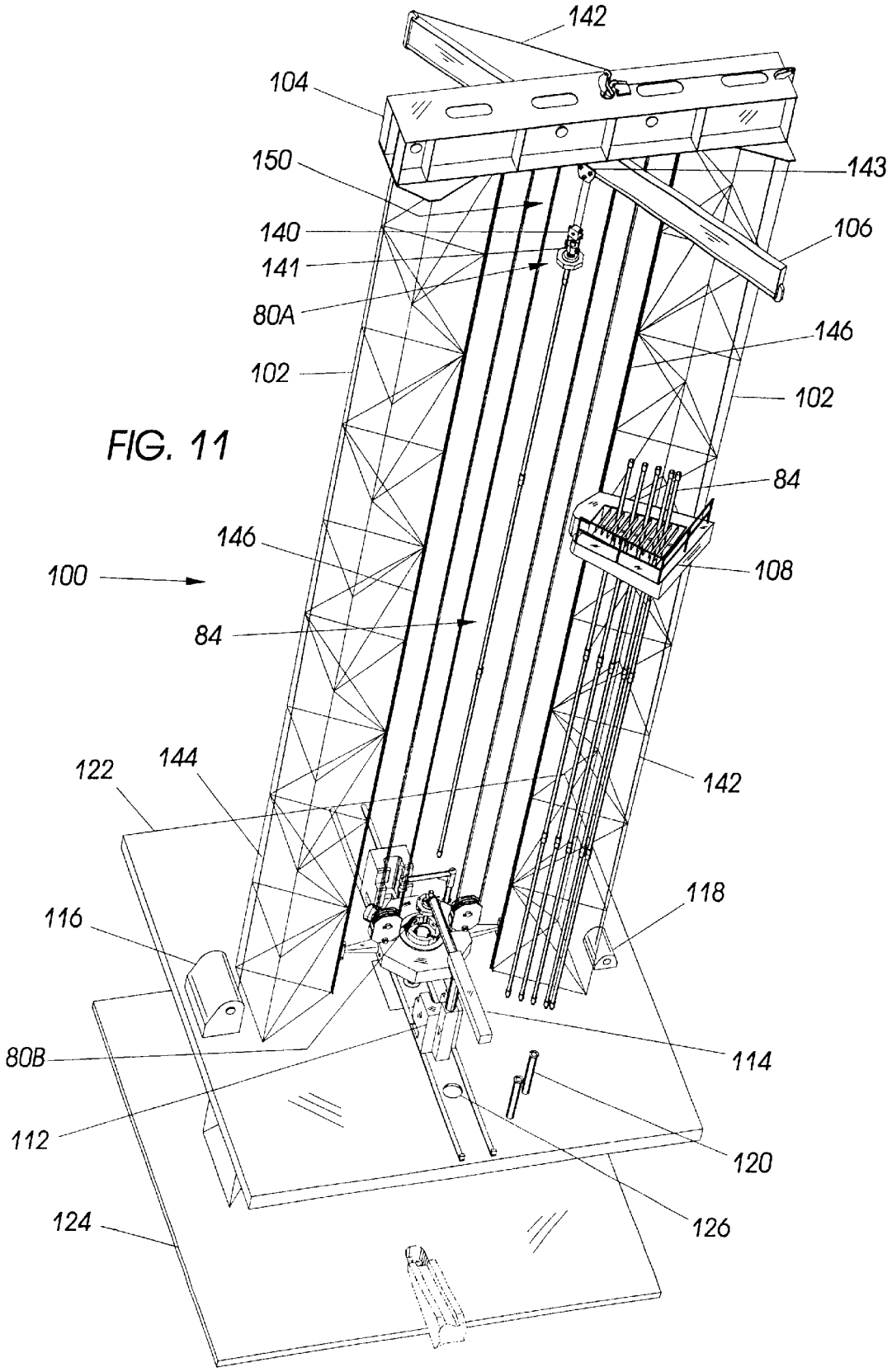
Figure 12:
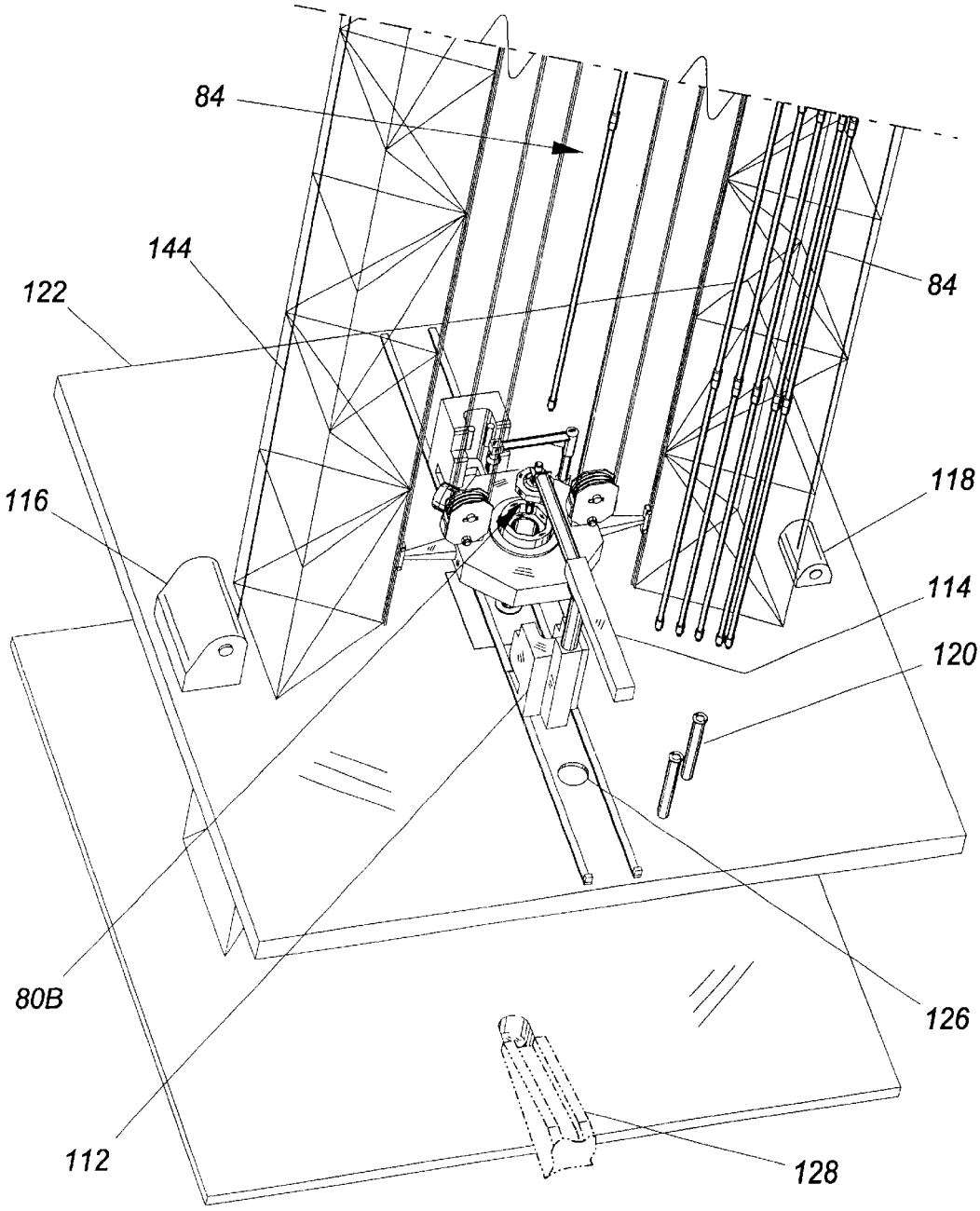

Once top drive 40 has drilled down the drill string, as depicted in FIG. 10, top drive 40 lifts the drill bit (not shown) attached to the bottom of the drill string off of the bottom of well hole 127, at which point the mud flow is stopped and slips 132 are set to support and hold drill string 90. While slips 132 are being set, mud line connector 76 is disconnected from the top of core stem 80B and mud line connection piping 70 is rotated out of the way as shown in FIG. 11 (note: FIG. 12 shows an enlarged view of the rig floor area of FIG. 11). Once the slips are set, backup wrench 60 is used to backup or hold drill string 90 in order for top drive 40 to break and rotate out core stem 80B from the drill string. In other embodiments it is possible to use backup tongs to prevent the drill string from rotating when breaking out core stem 80B. It should be noted that means and methods for breaking out and making up connections, such as built in top drive wrenches or tongs are well known to those in the art and the present invention is not limited to a specific type of wrench or tong known now or in the future.

Figure 13:
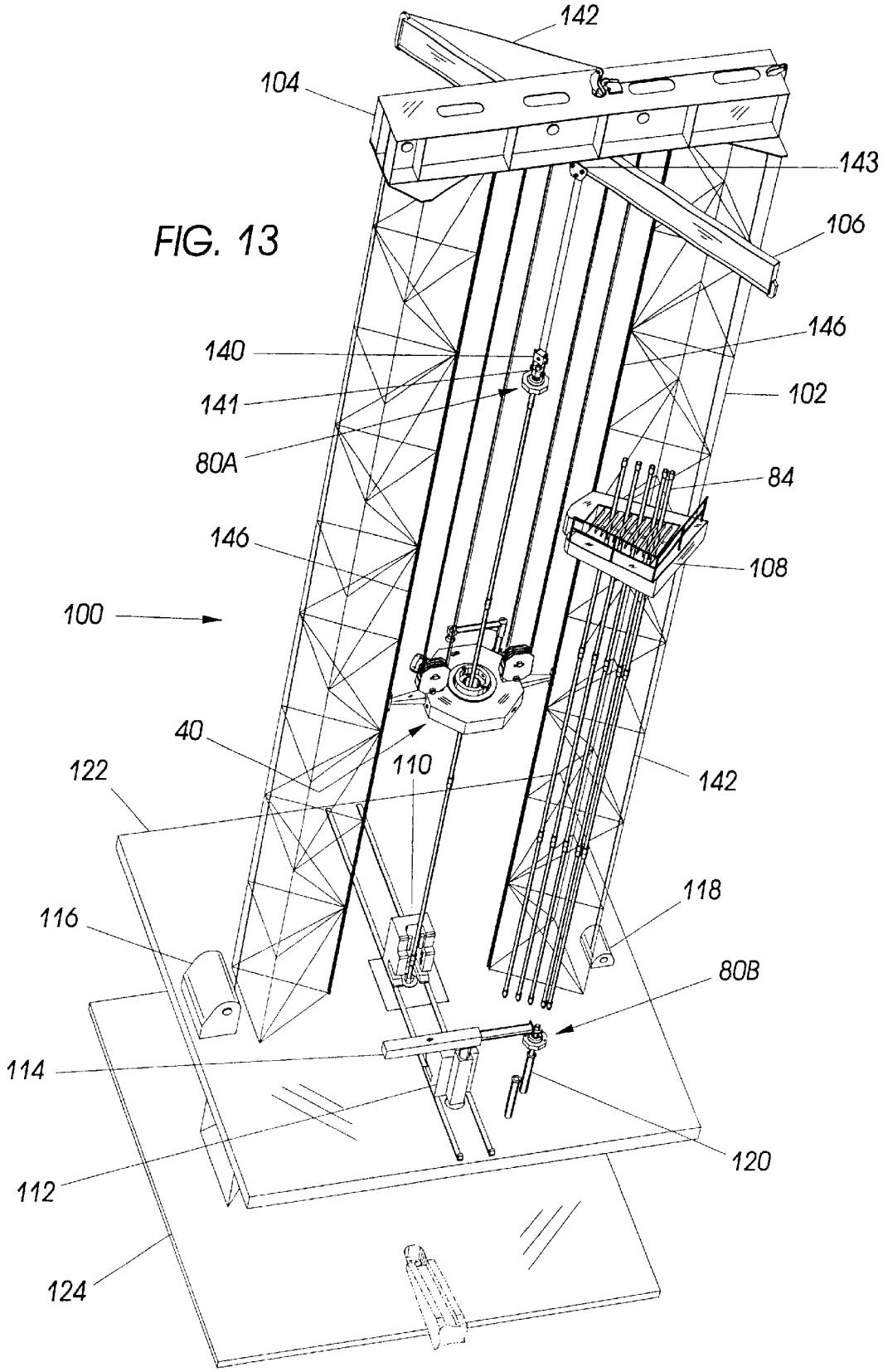

When core stem 80B has been broken out of the drill string, mechanical arm 114 removes core stem 80B from drive mechanism passage 53 and in this embodiment of the present invention places core stem 80B in a core stem stand 120 as shown in FIG. 13. It should be noted that there are many means and methods that can be utilized for moving or removing a core stem 80 to open up a main body passage 51. The present invention is not limited to a specific method or means for moving or removing core stem 80 to open up a main body passage 51. It should also be noted that the present invention is not limited as to the location of where core stem 80 is moved. Other non-limiting examples could be: (1) core stem 80B could be moved to another location on top drive 40 or (2) core stem 80B could be moved to some other location on drilling rig 100.

It should also be noted as previously mentioned that the present invention is not limited to two core stems. For example, embodiments of the present invention may comprise only one core stem which may be lifted and moved away from the mechanism passage without being detached from the mud line. One advantage of such an embodiment is that disconnecting the mud line from the first core stem and reconnecting the mud line to the second core stem are no longer necessary.

Another advantage of a one core stem embodiment wherein the one core stem remains attached to the mud line when lifted and moved away from drive mechanism passage 53 is that when tripping in and out of the well hole it would be easy to re-insert core stem 80 back into mechanism passage 53 and reconnect to drill string 90. This would allow turning the drill pipe and circulating drilling fluid for reaming the hole during the cycles of tripping in and tripping out.

Regardless of whether one or two (or more) core stems are utilized with the top drive of the present invention, the general operation and benefits are the same.

In another embodiment of the present invention comprising the use of at least two core stems, the at least two core stems may be attached to at least two separate mud lines. In such an embodiment there would be one core stem per mud line, and each core stem would remain attached to the mud line.

For this example, FIGS. 10–19, show a two core stem (80A and 80B) embodiment of the present invention, at a point when mechanical arm 114 has moved core stem 80B away from the centerline of well hole 127 and top drive 40. Top drive 40 is vertically raised, the beginning of which is shown in FIG. 13. At the same time, auxiliary hoist block 140 begins lowering core stem 80A and stand of pipe 84 attached thereto, down through main body passage 51 of top drive 40. The stand of pipe 84 is then stabbed into drill string 90 which is being supported by slips, and a torque and spinning wrench 110 (or other suitable means for making up a connection) is used to make up the connection between the new stand of pipe 84 and drill string 90 as shown in FIG. 13.

Figure 14:
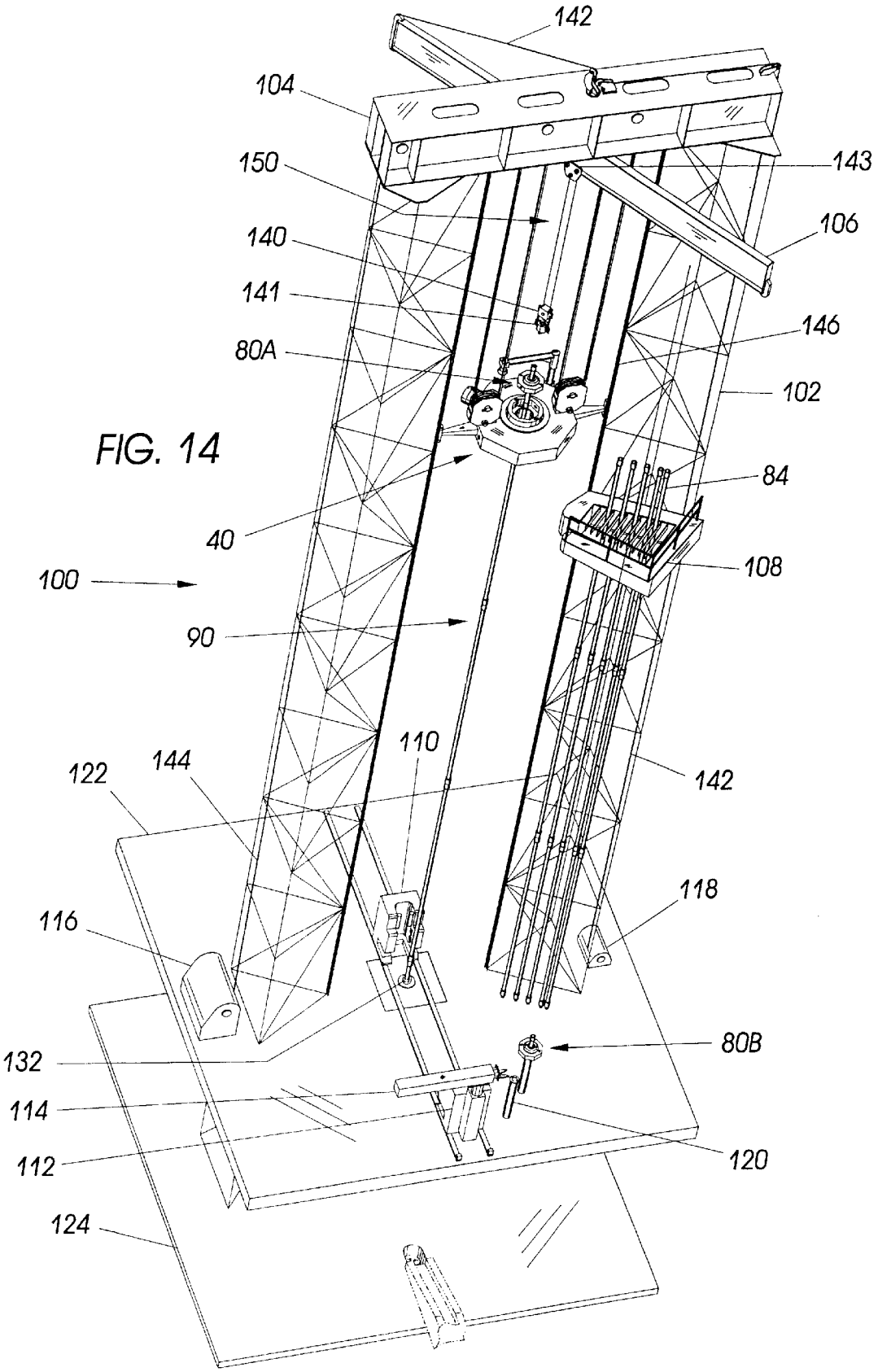

Auxiliary hoist elevator 141 then releases core stem 80A. Auxiliary hoist elevator 141 and auxiliary hoist block 140 are raised out of the way. Also occurring at this time, top drive 40 is raised to a predetermined proximity near core stem 80A, as shown in FIG. 14. In one embodiment of the present invention, a limit switch may be provided. The limit switch is tripped once top drive 40 has reached a predetermined proximity to core stem 80A, thereby slowing or stopping top drive 40 to prevent it from contacting core stem 80A at full hoisting speed.

Figure 15:
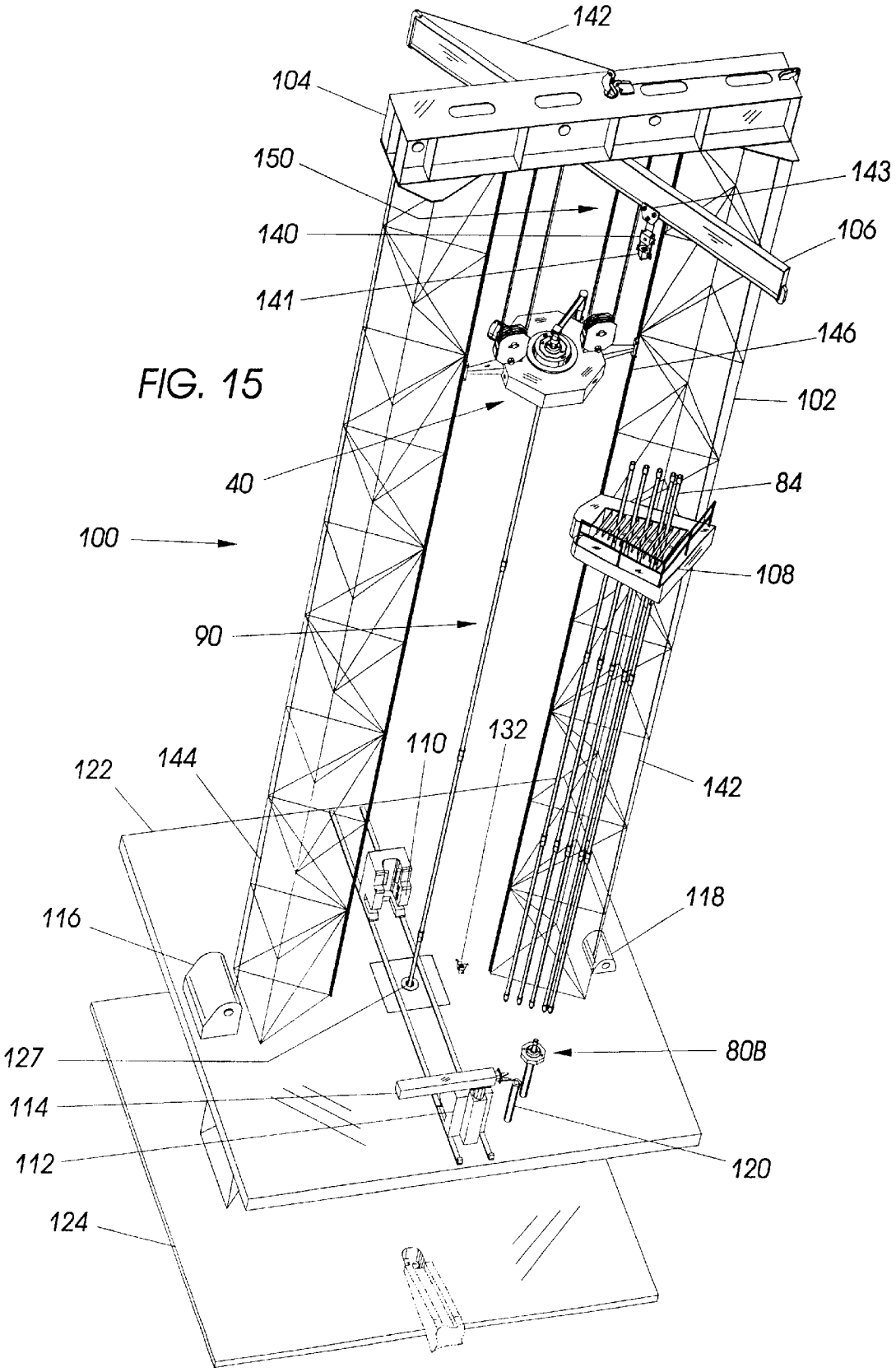

As shown in FIG. 15, top drive 40 is then raised the final remaining distance between drive mechanism 52 and core stem 80A in order to make contact with core stem 80A and in order for core stem 80A to be positioned into drive mechanism passage 53 as shown in FIG. 7 and FIG. 15. Mud line connection piping 70 is rotated, lowered, and connected to core stem 80A. Next, top drive 40 lifts the entire drill string 90 and the slips are removed, mud flow is started, and drilling resumes. FIG. 15 depicts top drive 40 at the position just prior to drilling down a new stand of pipe 84.

Figure 16:
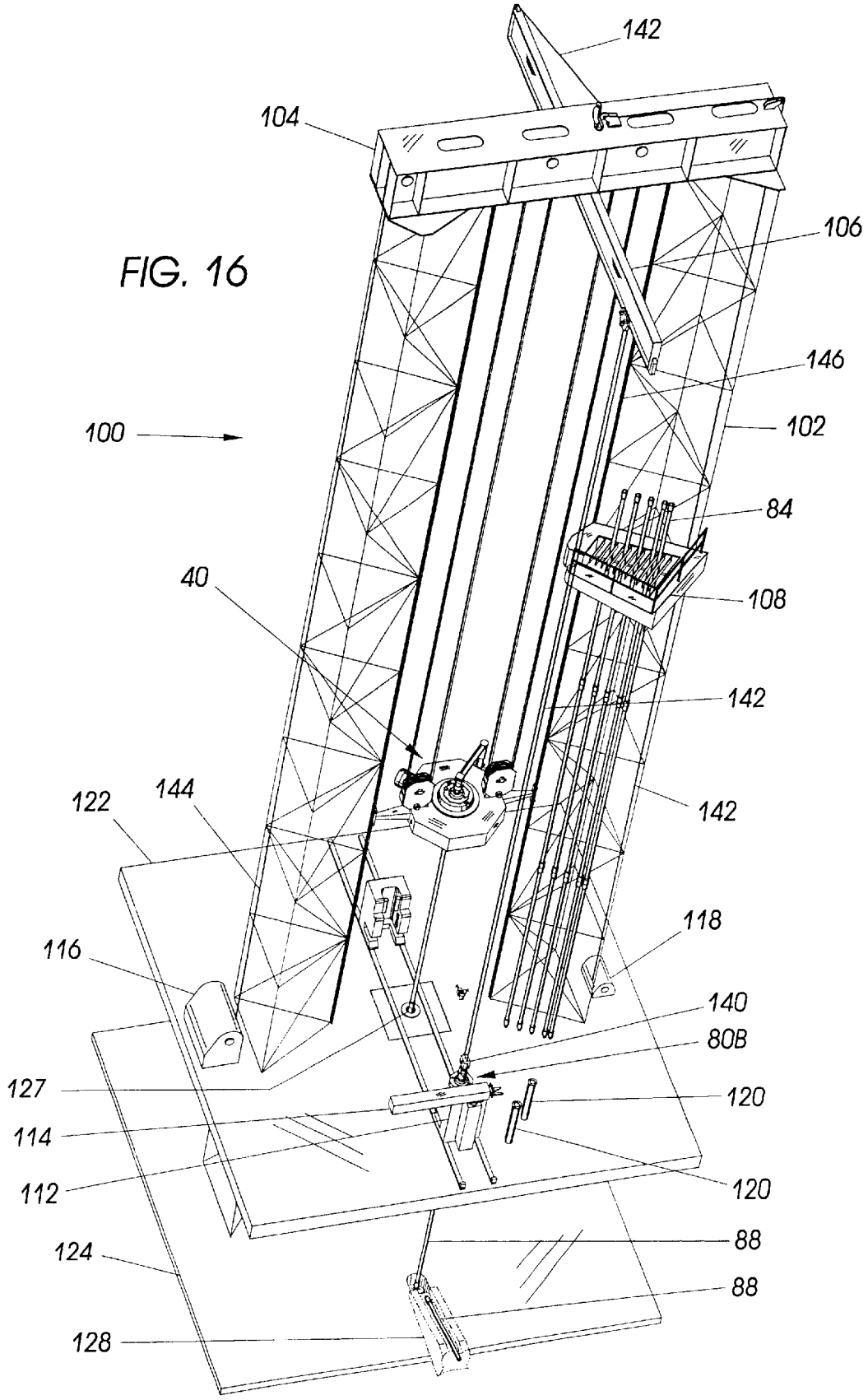
Figure 17:
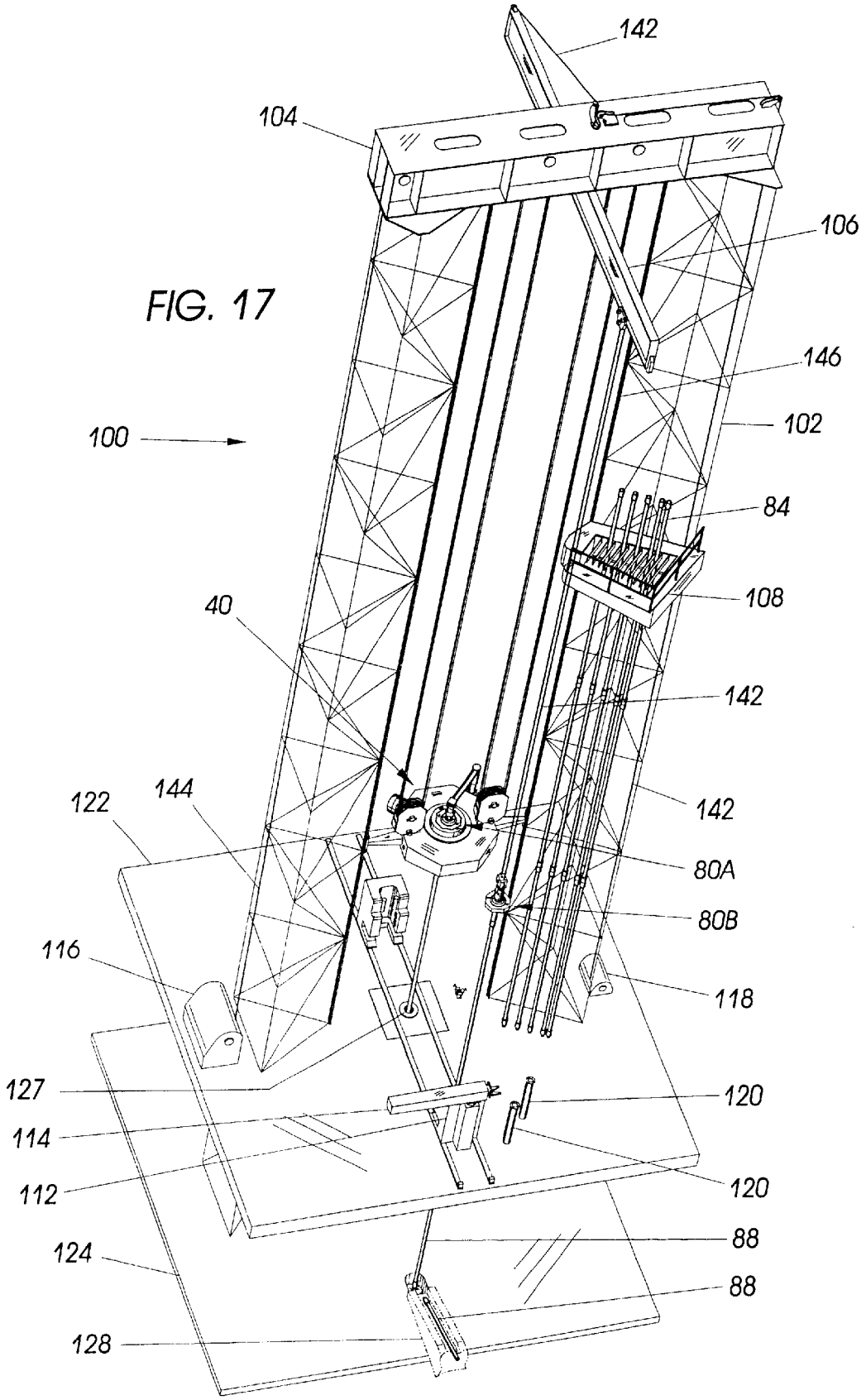
Figure 18:
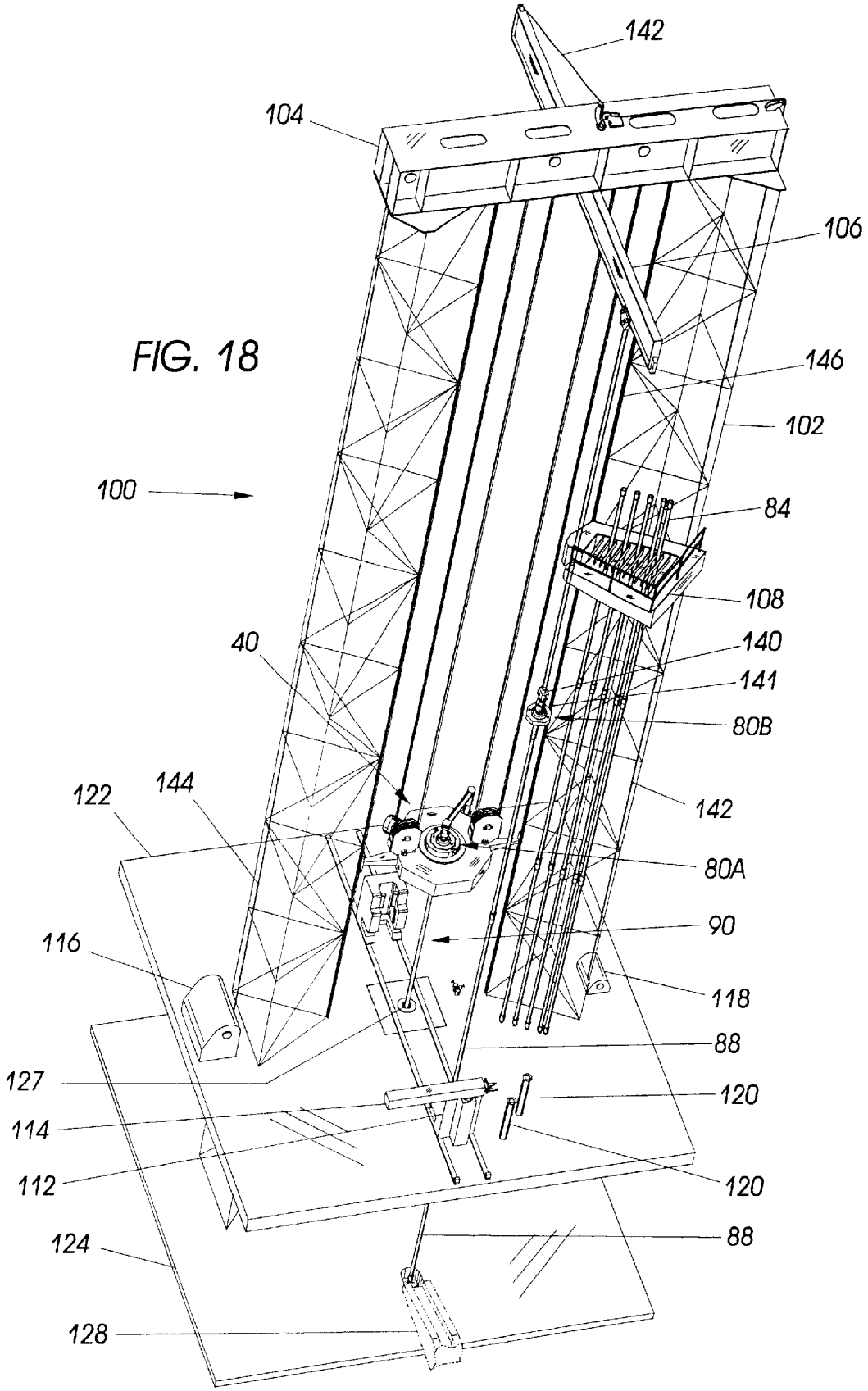
Figure 19:
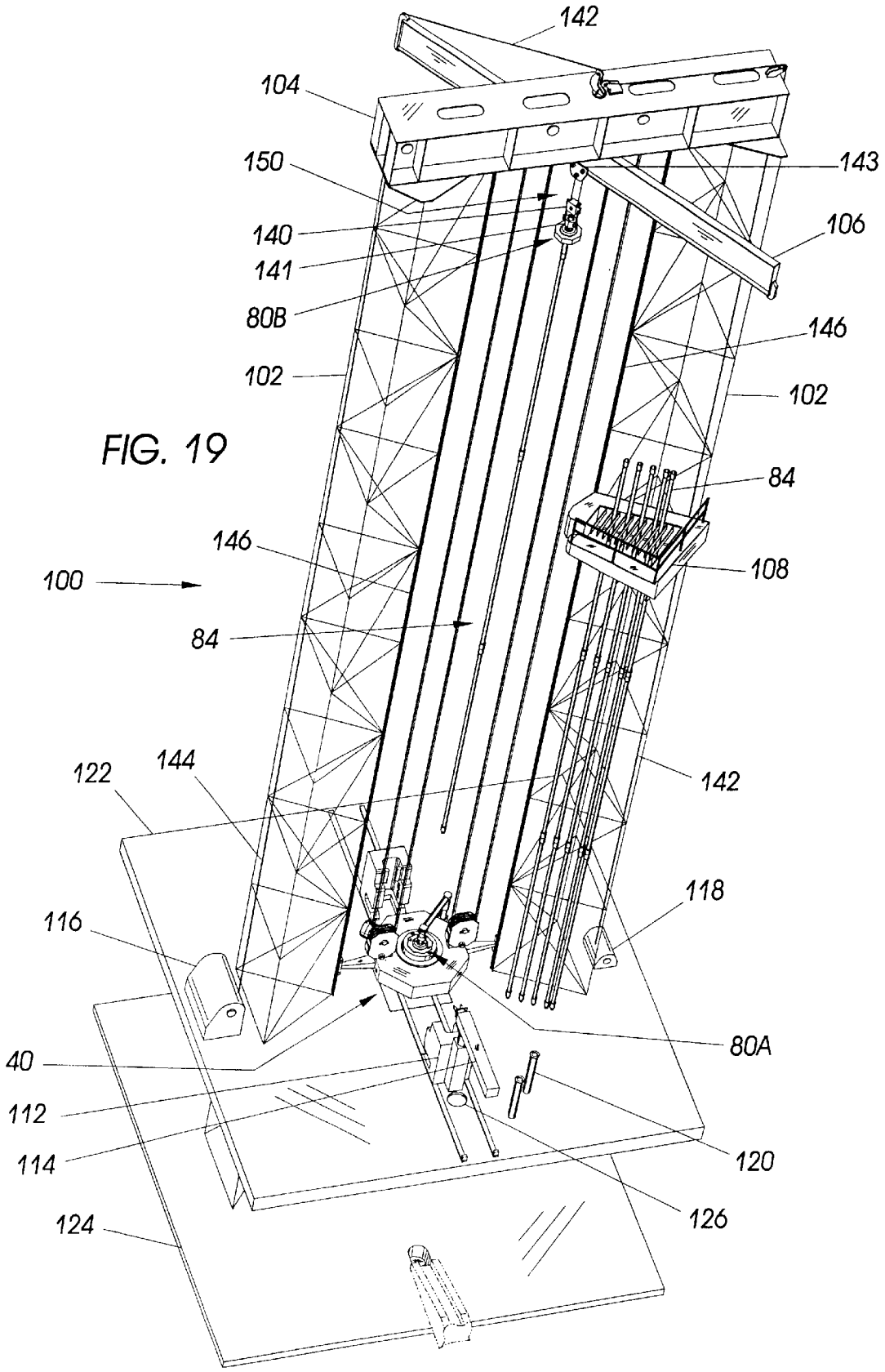

Referring now to FIGS. 16–19, as top drive 40 is drilling down the newly added stand of pipe 84 to drill string 90, a stand of pipe 84 can be made up to core stem 80B. Auxiliary hoist elevator 141 lifts core stem 80B from core stem stand 120 and positions it over opening 126 in drill floor 122 where new joints of drill pipe 88 from pipe ramp 128 are raised from lower level 124. FIG. 16 shows torque and spinning wrench 112 making up core stem 80B to a first joint of drill pipe 88. Once the connection is made-up, auxiliary hoist elevator 141 raises core stem 80B and first joint of drill pipe 88. FIG. 17 shows torque and spinning wrench 112 making-up the connection between a second joint of drill pipe 88 and the first joint of drill pipe 88. Once this connection is made-up, the double joint of drill pipe is raised and a third joint of drill pipe 88 is added to the second joint of drill pipe 88 in a similar manner, as shown in FIG. 18. After the third joint of drill pipe 88 has been made-up to produce a three joint stand of pipe 84 (also referred to as a thribble), auxiliary hoist elevator 141 raises and positions core stem 80B and stand of pipe 84 to a position over top drive 40 and in alignment with the centerline of well hole 127 as shown in FIG. 19. This completes the drilling cycle of one stand of drill pipe and brings the drilling cycle back to the phase shown in FIG. 10. From this phase, the above-described drilling cycle is repeated as necessary.

Of course, while three joints of drill pipe 88 have been shown as making up a stand of drill pipe 84, more or less than three joints of drill pipe 88 may be utilized in the practice of the present invention.

Example 2

Drilling Procedure for Tripping Out Stands of Drill Pipe Using the Present Invention Referring now to FIGS. 20–26 there is shown one embodiment of the present invention for tripping out stands of pipe 84.

Figure 20:
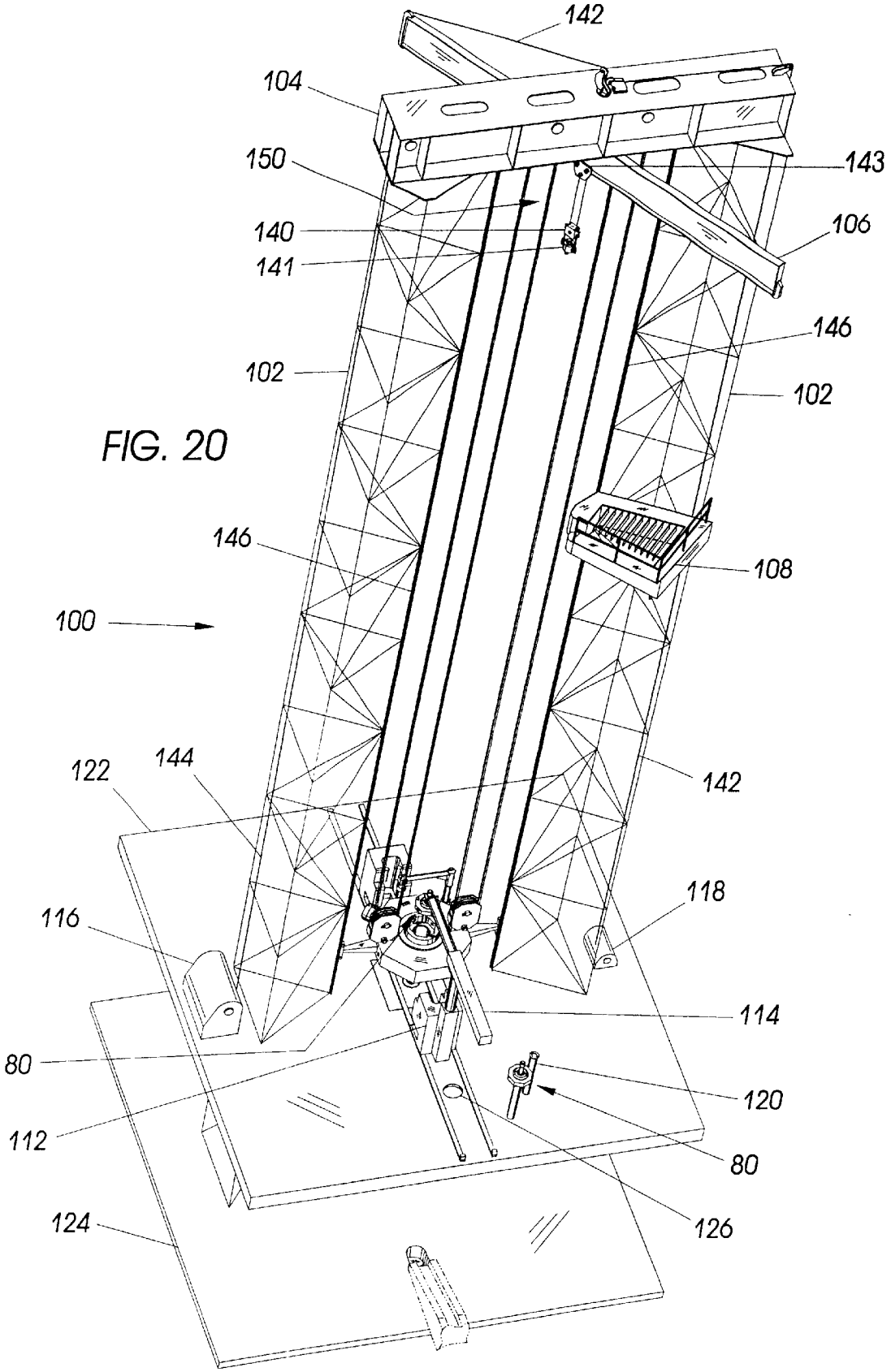
FIGS. 20–26 are a depiction of one embodiment of the tripping out drilling procedure of the present invention.

FIG. 20 shows top drive 40 at the start of the tripping out cycle wherein drill string 90 has been drilled down, top drive 40 is in proximity to the drill floor. Top drive 40 lifts drill bit (not shown, attached to the bottom of the drill string) off the bottom of well hole 127, the mud (drilling fluid) flow is stopped, and slips 132 are set to support and hold drill string 90. While slips 132 are being set, mud line connector 76 is disconnected from the top of core stem 80 and mud line connection piping 70 is rotated out of the way. After the slips are set, backup wrench 60 (or another means to prevent the drill string from rotating when breaking out core stem 80, such as backup tongs) is used to backup or hold drill string 90 in order for top drive 40 to break and rotate out core stem 80 from the drill string. It should be noted that means and methods for breaking out and making up connections, such as built in top drive wrenches or tongs are well known to those in the art and the present invention is not limited to a specific type of wrench or tong known now or in the future.

Figure 21:
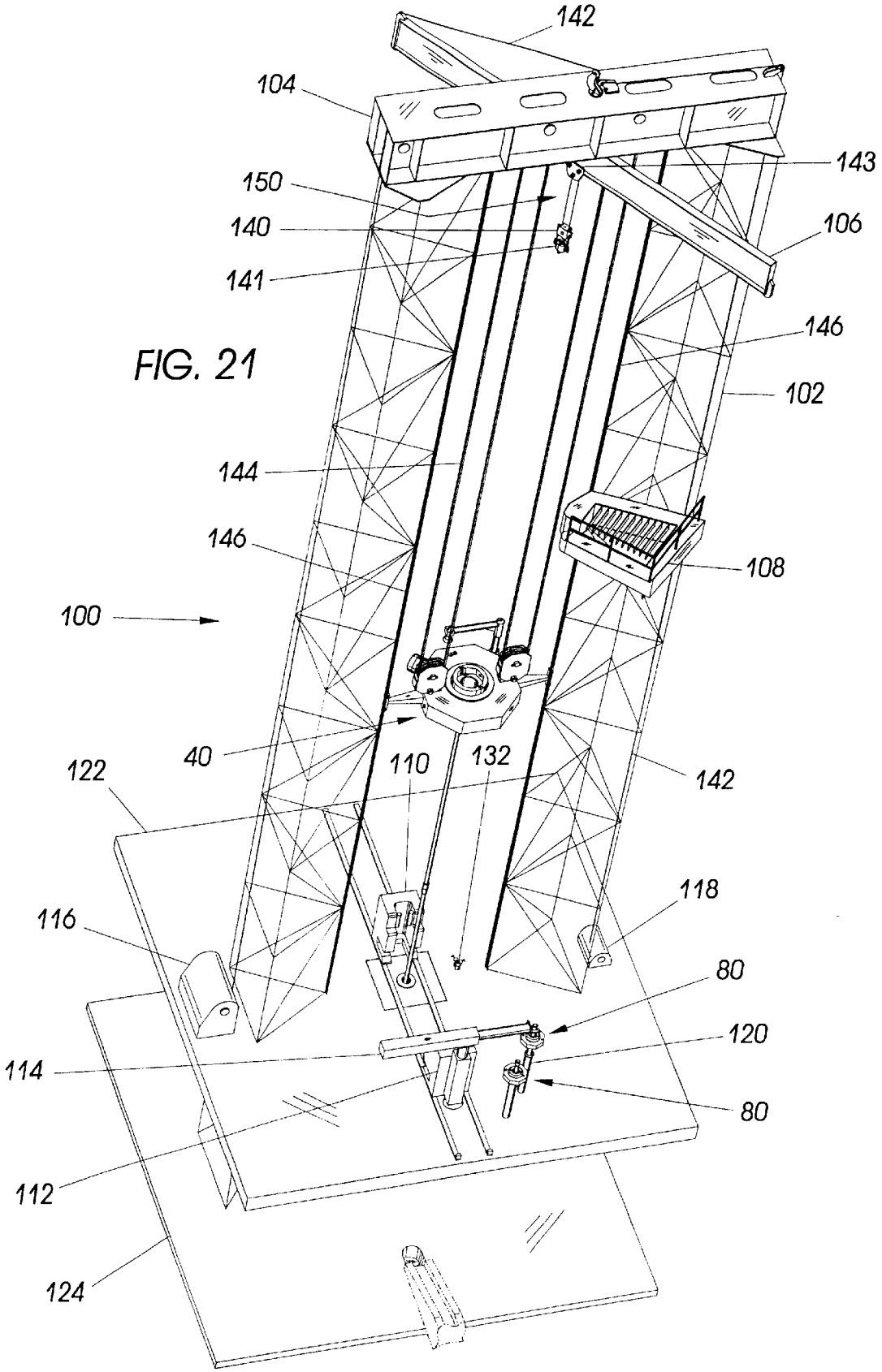

When core stem 80 has been broken out of the drill string, mechanical arm 114 removes core stem 80 from drive mechanism passage 53 and in this embodiment of the present invention places core stem 80 in core stem stand 120 as shown in FIG. 21. It should be noted that there are many means and methods that can be utilized for moving or removing a core stem to open up a main body passage 51 and that the present invention is not limited to a specific method or means for moving or removing core stem 80. It should also be noted that the present invention is not limited as to the location of where core stem 80 is moved as mentioned in the previous example.

For the one core stem embodiment of the present invention also mentioned in the previous example, the core stem may be lifted from mechanism passage 53 and rotated or retracted from the centerline of well while remaining connected to the mud line.

When core stem 80 has been removed from main body passage 51, top drive elevator 64A, located and supported from underneath top drive 40 as shown in FIG. 3, is closed to connect to drill string 90. It should be noted that elevators are well known to those in the art and the present invention is not limited to a specific type, size, or style of elevator known now or in the future.

Also it should be noted that the present invention is not limited by the location of top drive elevator 64. Another non-limiting embodiment of the invention is for the top drive elevator to be located on the topside of top drive 40. This embodiment is represented by top drive elevator 64B, shown in FIG. 3. Also other non-limiting examples of embodiments of top drive elevators are: a remotely operated elevator (such as, an elevator that is able to be opened or closed from a remote location) as compared to a manually operated elevator (such as, an elevator that can only be opened or closed manually at the elevator). Also it should be noted that top drive elevators can be made to be permanently attached to the top drive unit or can be made to be easily removed or attached, and thus be made available when needed but removed when not needed.

After top drive elevator 64A in this embodiment, (Note: there is no top side elevator 64B in this example and embodiment) closes and connects to drill string 90, drawworks 116 by means of main drawworks wireline 144 begins to raise top drive 40 which raises top drive elevator 64A and drill string 90. Slips 132 are then removed. FIG. 21 depicts top drive 40 at the start of tripping (or lifting) the first stand of pipe 84 out of well hole 127.

Figure 22:
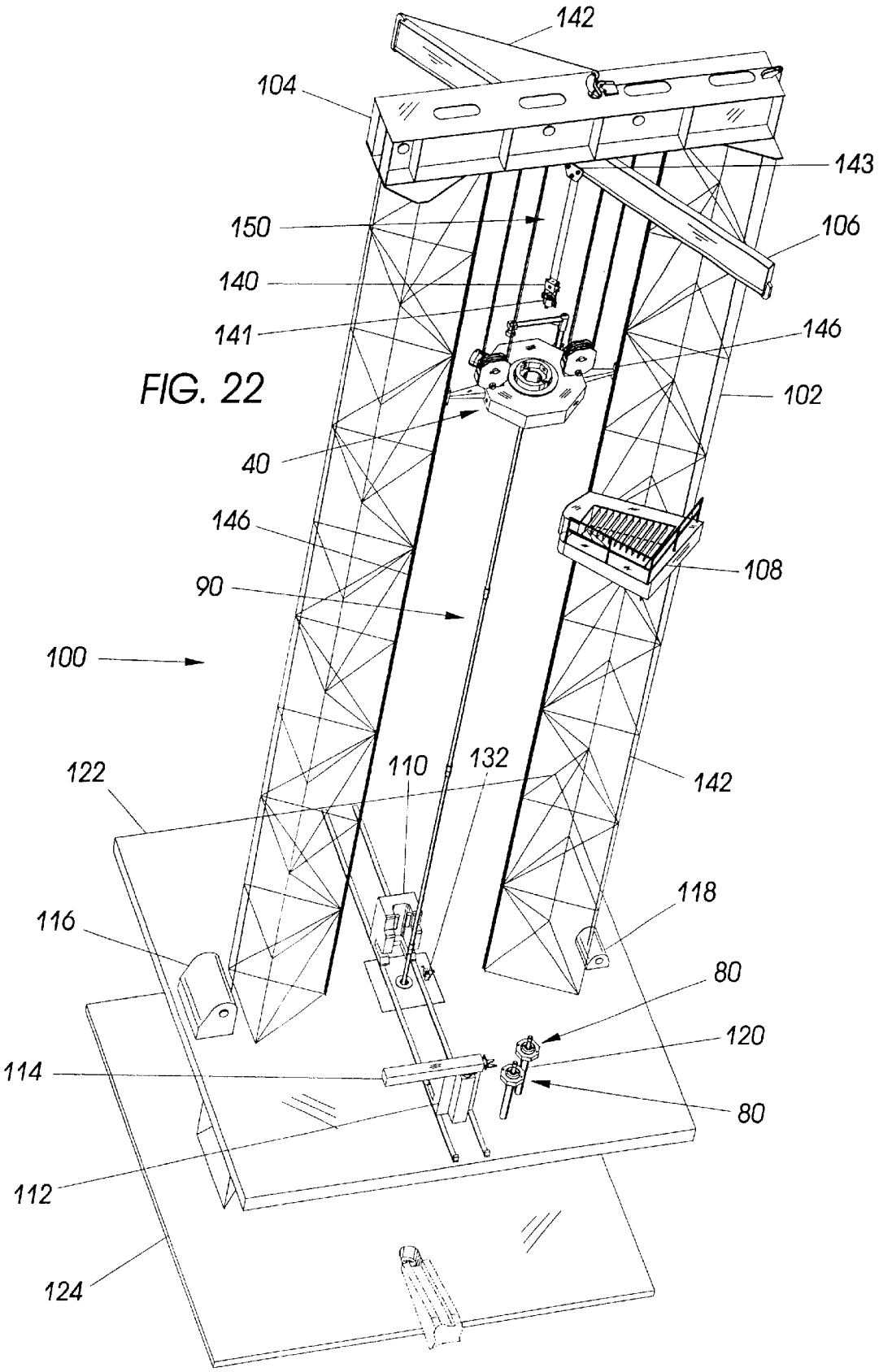

Referring now to FIG. 22, there is shown the top three joints of drill string 90 which have been raised out of well hole 127 just prior to setting slips 132 to hold drill string 90.

Figure 23:
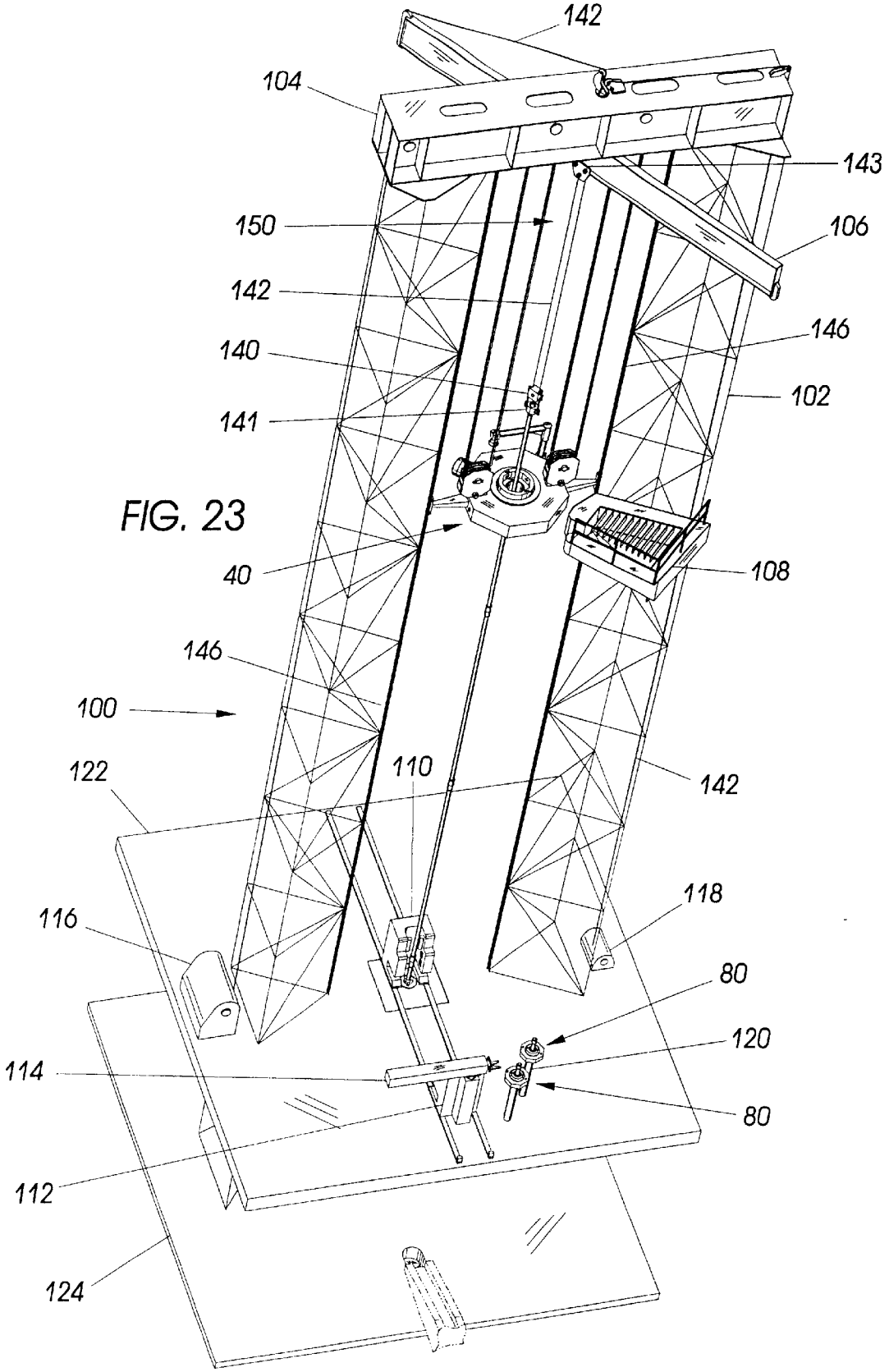

Referring now to FIG. 23, after setting slips 132, the following three events take place: (1) top drive 40 begins being lowered back down to drill floor 122; (2) auxiliary hoist elevator 141 is lowered and connects to the top end of drill string 90; and (3) torque and spinning wrench 110 breaks out a stand of pipe 84 from drill string 90. In a preferred embodiment, the three steps take place simultaneously.

Figure 24:
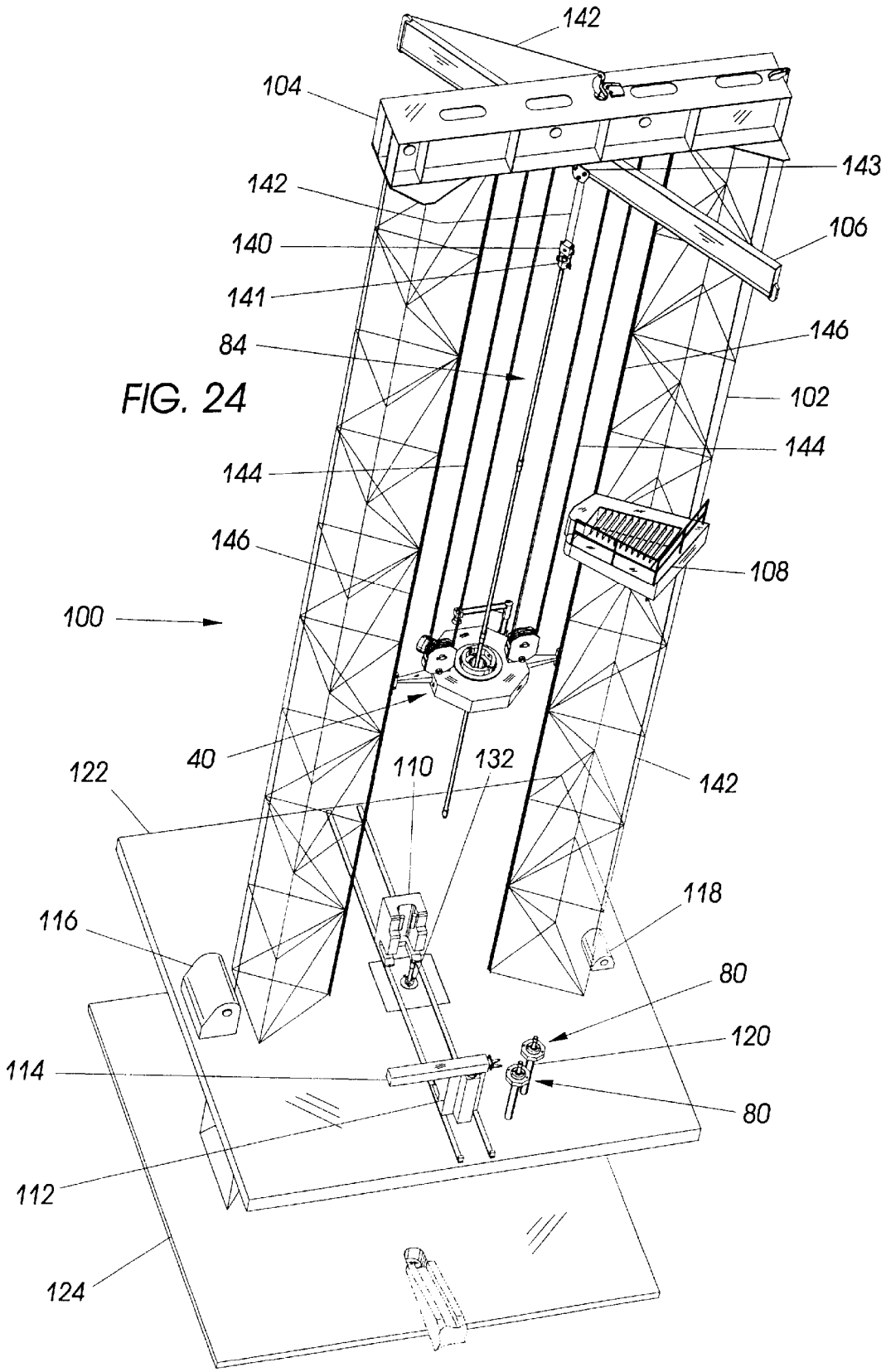

Referring now to FIG. 24, as soon as torque and spinning wrench 110 breaks out stand of pipe 84, auxiliary hoist elevator 141 lifts stand of pipe 84 and waits until top drive 40 clears bottom end 87 of stand of pipe 84.

Figure 25:
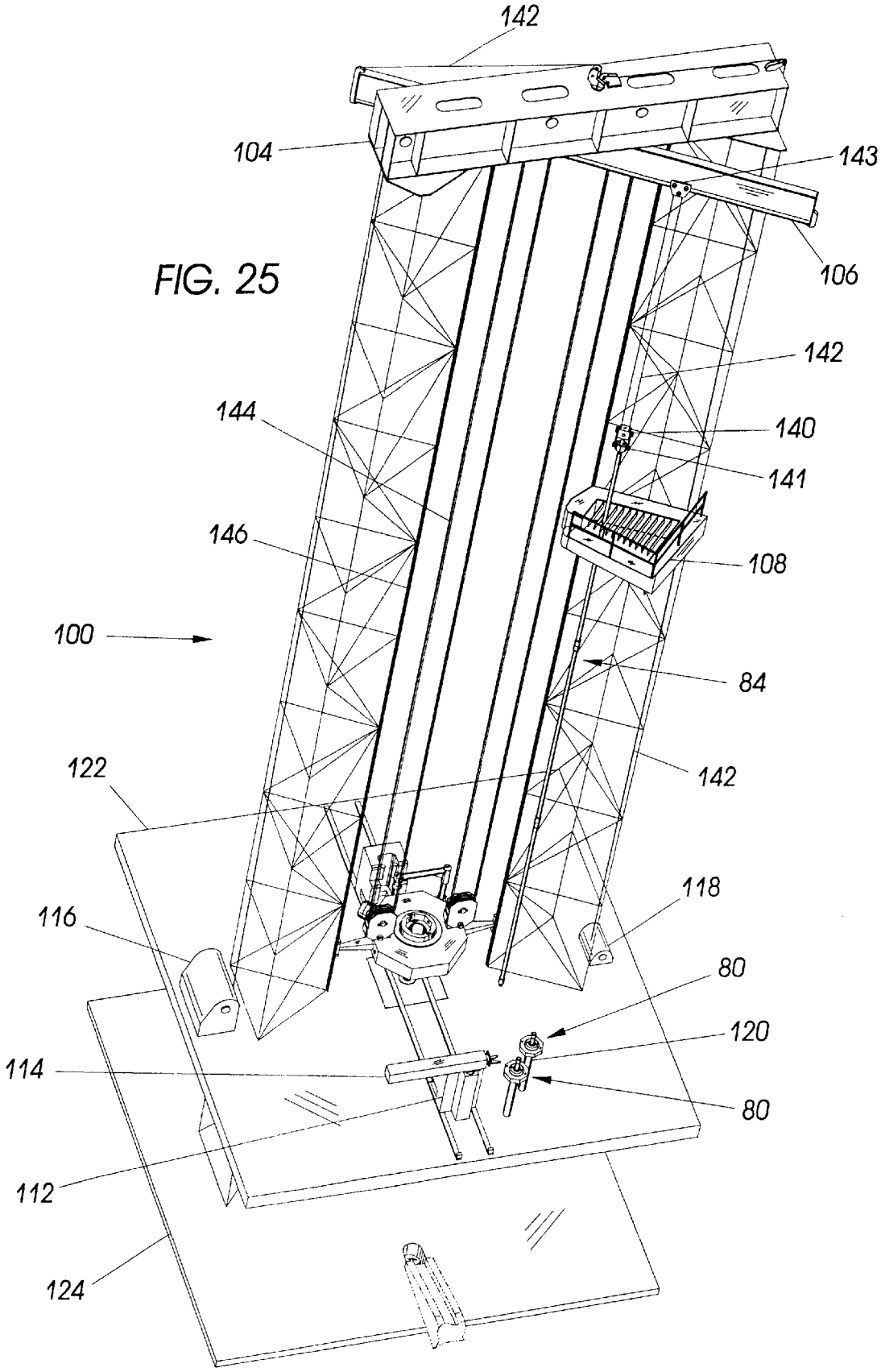

Once bottom end 87 of stand of pipe 84 and top drive 40 have passed each other, auxiliary hoist elevator 141 moves stand of pipe 84 to fingerboard stand rack 108 as shown in FIG. 25.

By this time, as also shown in FIG. 25, torque and spinning wrench 110 has been moved out of the way and top drive 40 has reached top end 91 (shown in FIG. 24) of drill string 90 which is being support by slips 132 near drill floor 122.

Figure 26:
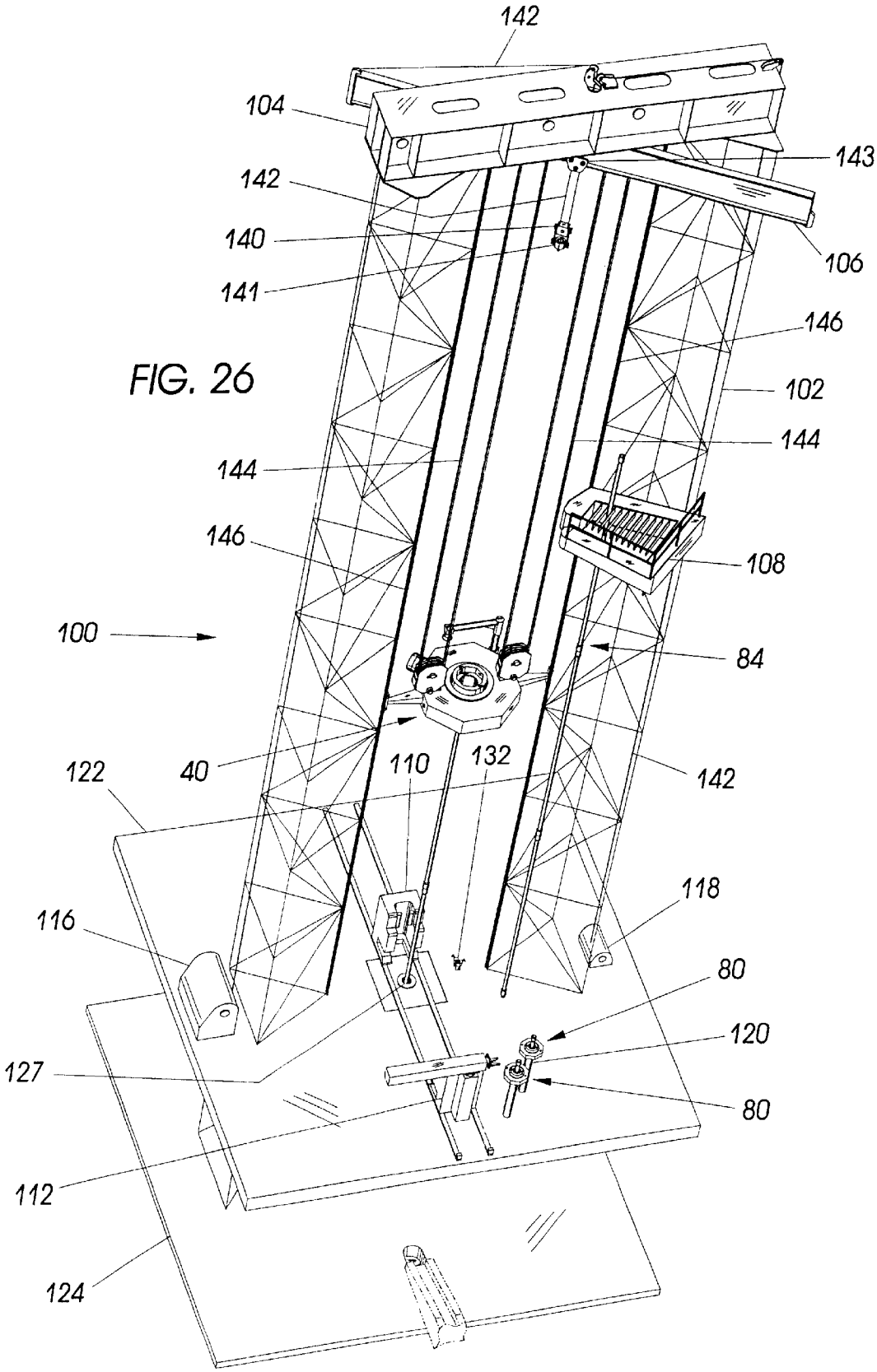

Referring now to FIG. 26, once auxiliary hoist elevator 141 has released stand of pipe 84 in fingerboard stand rack 108, it returns to the position at the centerline of well hole 127 and awaits the next stand of pipe to be broken out of drill string 90. At the same time, top drive elevator 64A connects to top end 91 of drill string 90. Top drive 40 then begins raising drill string 90 and slips 132 are then removed (in other embodiments slips may only need to be opened and not removed from well hole 127). This returns the tripping out cycle to the phase shown in FIG. 21 and completes one cycle of tripping out.

Example 3

Drilling Procedure for Tripping In Stands of Drill Pipe Using the Present Invention Referring now to FIGS. 27–32 there is shown one embodiment of the tripping in cycle using the present invention.

The events or steps of the tripping in cycle are similar to those of the tripping out cycle as illustrated in Example 2, except they are carried out in a reversed order.

Figure 27:
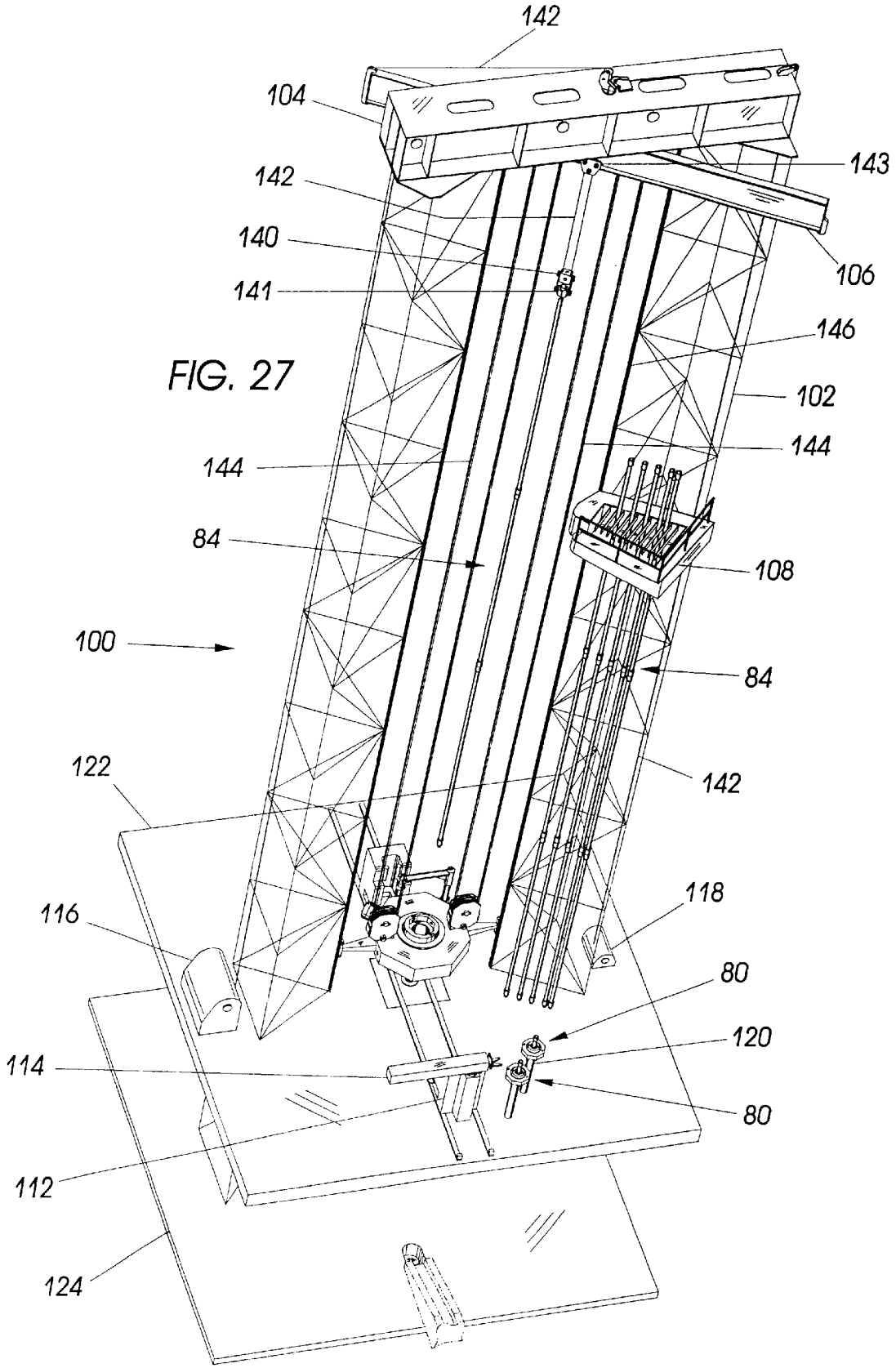
FIGS. 27–32 are a depiction of one embodiment of the tripping in drilling procedure of the present invention.

FIG. 27 depicts a phase in the tripping in cycle wherein auxiliary hoist elevator 141 has positioned stand of pipe 84, which is to be added to drill string 90, directly over top drive 40 and in alignment with the centerline of well hole 127. Slips 132 are supporting drill string 90. Top drive elevator 64A has opened and released drill string 90. (Note: the discussion in Example 2 on top drive elevator 64A and 64B is also applicable for this Example.)

Figure 28:
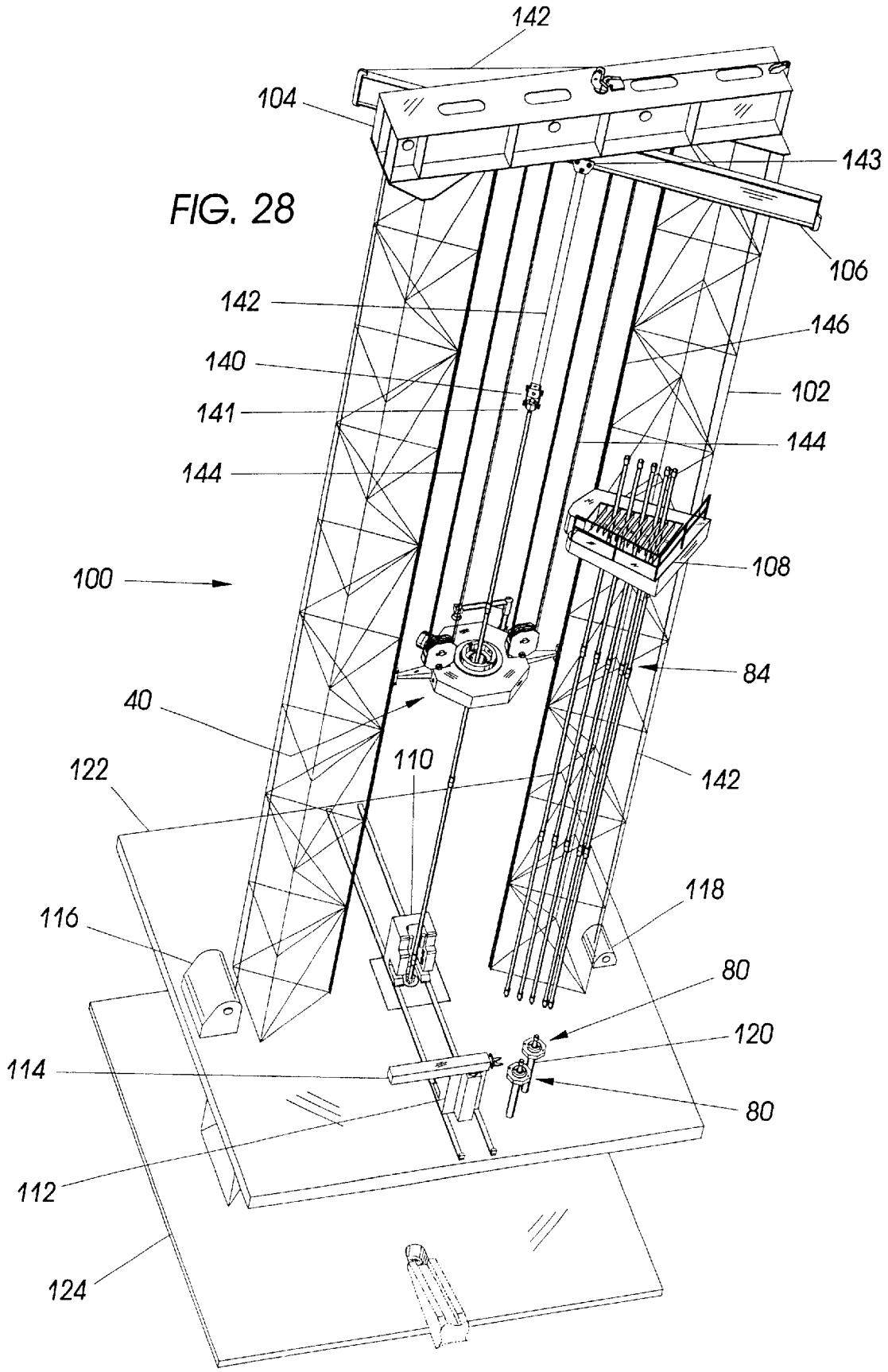

At this point, the raising of top drive 40 to the top of stand of pipe 84 begins. At the same time, stand of pipe 84 is lowered through main body passage 51 of top drive 40 to be stabbed into, and made up to (threaded and properly torqued) the top end of drill string 91. As soon as top drive 40 is raised to a predetermined height above torque and spinning wrench 110, torque and spinning wrench 110 moves in position to torque and make up the connection between the new stand of pipe 84 and drill string 90. FIG. 28 depicts top drive 40 and torque and spinning wrench 110 at this phase in the tripping in cycle.

Once stand of pipe 84 has been made up to drill string 90, auxiliary hoist elevator 141 releases stand of pipe 84 and auxiliary hoist elevator 141 is raised out of the way.

At this time, top drive 40 is nearing the top end of stand of pipe 84 now a part of drill string 90. In one embodiment of the present invention, a limit switch may be provided which is tripped once top drive 40 has reached a predetermined proximity to the top end of drill string 90. The tripping of the limit switch results in the slowing or stopping of the movement of top drive 40 in order to prevent top drive elevator 64 from closing and contacting the top end of drill string 90 at full hoisting speed.

Figure 29:
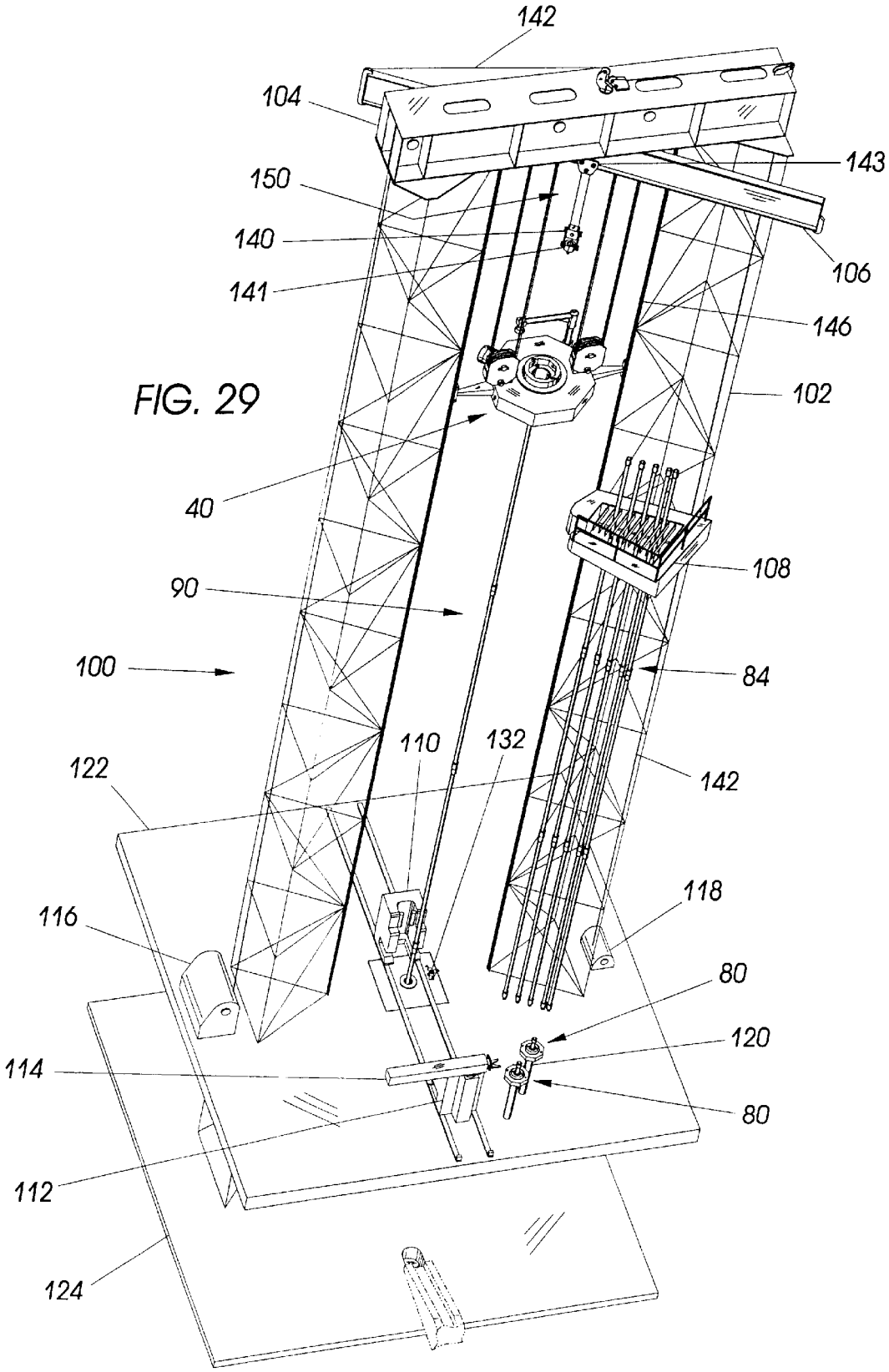

Top drive elevator 64A is then closed around drill string 90. Top drive 40 is then raised the final remaining distance between top drive elevator 64A and the bottom shoulder of the top tool joint of drill string 90. By this time, torque and spinning wrench 110 has been moved back out of the way. Top drive 40, connected to drill string 90 by top drive elevator 64A, then lifts drill string 90 in order for slips 132 to be removed (or released in other embodiments). FIG. 29 depicts top drive 40, auxiliary hoist elevator 141, torque and spinning wrench 110, and slips 132 at this point in the tripping in cycle.

Figure 30:
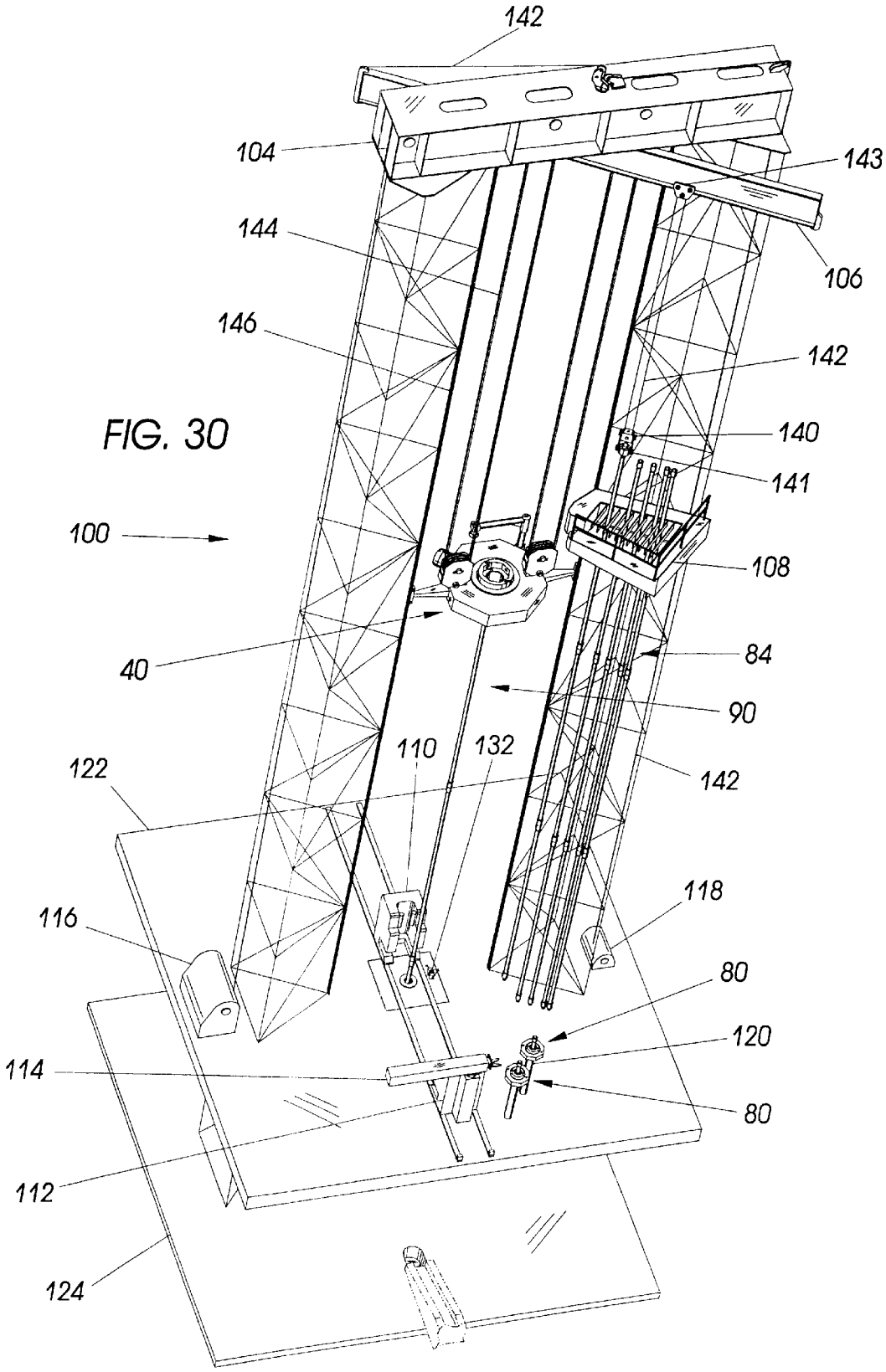
Figure 31:
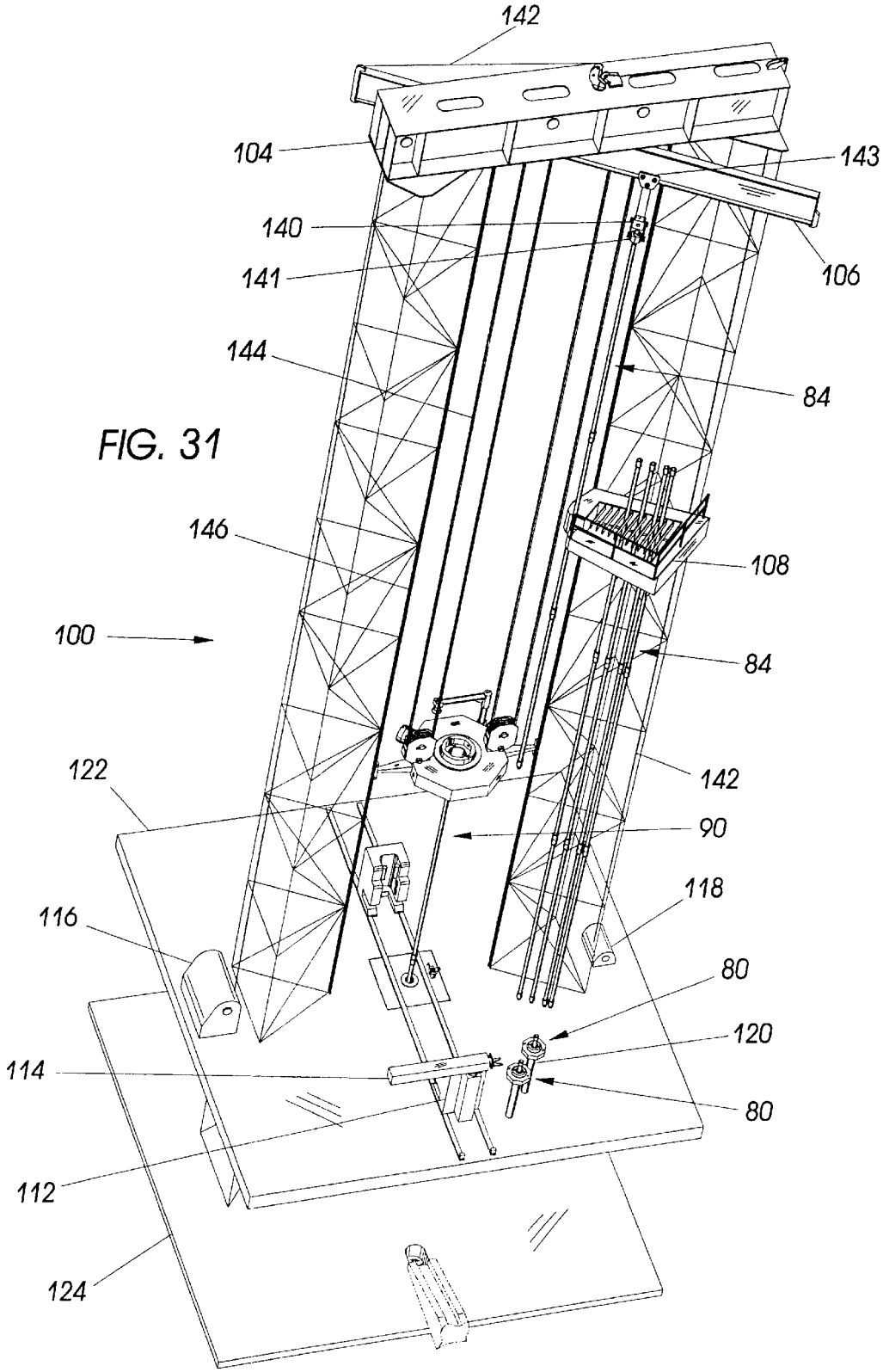
Figure 32:
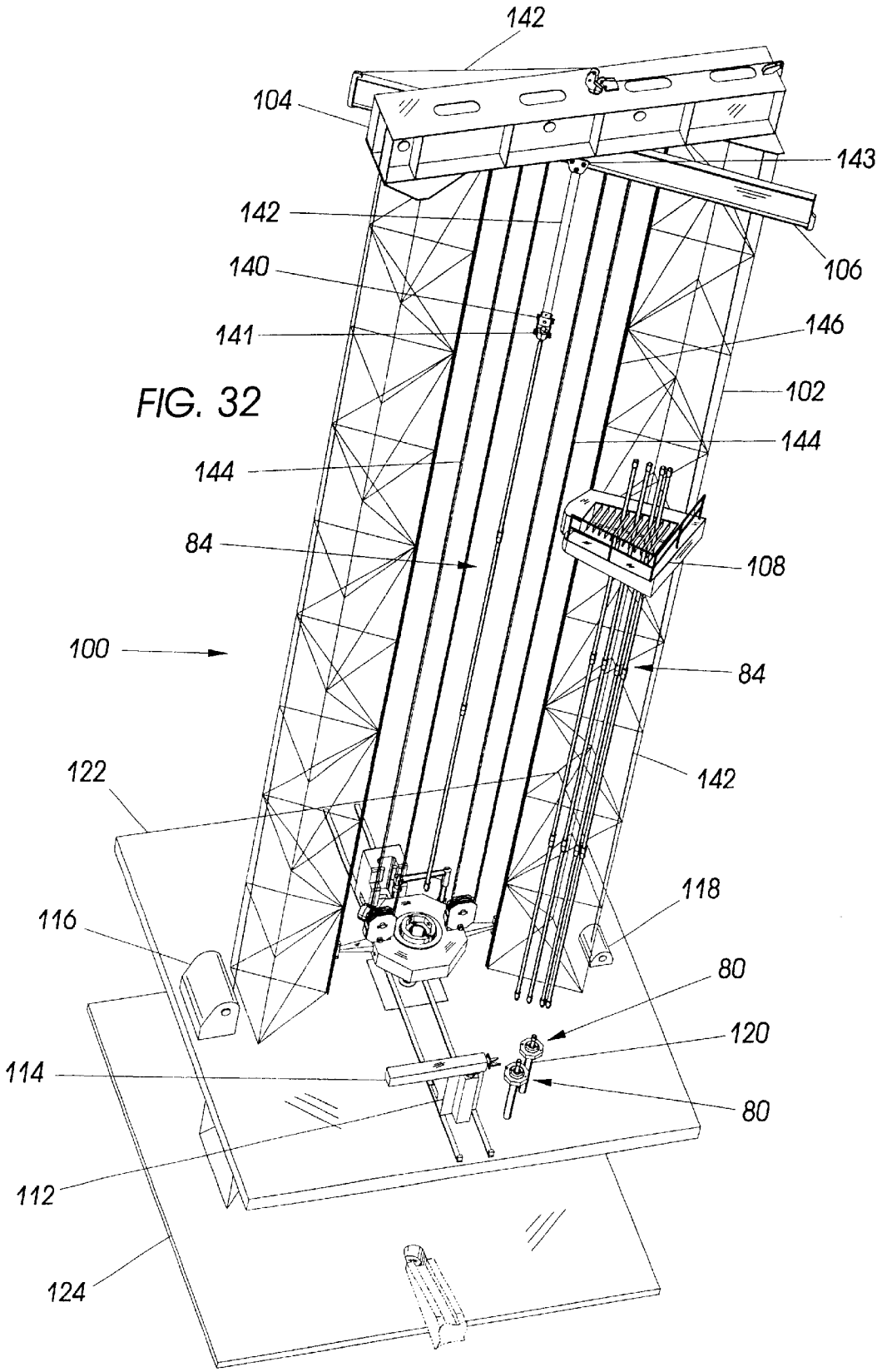

As shown in FIG. 30, top drive 40 then starts to lower the newly added stand of pipe into well hole 127. Also shown in FIG. 30, auxiliary hoist elevator 141 has connected to the top end of the next stand of pipe 84 to be added to drill string 90. Referring now to FIG. 31, as top drive 40 is lowering drill string 90, auxiliary hoist elevator 141 begins to position the next stand of pipe 84, for addition to drill string 90, over top drive 40 and in alignment with centerline of well hole 127 as shown in FIG. 32. Once top drive 40 nears drill floor 122, slips 132 are set and top drive elevator 64 releases drill string 90.

This returns the tripping in cycle to the phase shown in FIG. 27 and completes one cycle of tripping in.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains. Thus, the specification and examples should be considered exemplary only with the true scope and spirit of the invention indicated by the following claims.

I claim:

1. A drilling apparatus comprising:

a main body defining a main body passage extending therethrough; and a drill string drive mechanism rotatably positioned within said main body passage wherein said drill string drive mechanism defines a mechanism passage through said main body passage, wherein said mechanism passage is adapted to allow travel of drill pipe therethrough, wherein said drill string drive mechanism is rotatable in relation to said main body, wherein said drill string drive mechanism is adapted to be driven by a motor, and wherein said drill string drive mechanism is adapted to drive a drill string;

a hollow core stem positioned in said mechanism passage, wherein said hollow core stem comprises a connecting member connecting said hollow core stem to said drill string drive mechanism, a first end extending into said mechanism passage and positioned for connection to said drill string, and a second end adapted for connection to a mud line assembly.

2. The drilling apparatus of claim 1 wherein said second end is rotatable relative to said connecting member and said first end.

3. The drilling apparatus of claim 1 wherein said second end is adapted for connection to a mud line connector of said mud line assembly, wherein said mud line connector is rotatable relative to the second end.

4. The drilling apparatus of claim 1 further comprising:

a vertically extending tower supporting said main body wherein said main body is movably affixed to and moves vertically relative to said vertically extending tower.

5. A drilling apparatus comprising:

a vertically extending tower supporting a main body, said main body defining a main body passage extending therethrough, wherein said main body comprises a drill string drive mechanism rotatably positioned within said main body passage wherein said drill string drive mechanism defines a mechanism passage through said main body passage, wherein said mechanism passage is adapted to allow travel of drill pipe therethrough, wherein said drill string drive mechanism is rotatable in relation to said main body, wherein said drill string drive mechanism is adapted to drive a drill string; and a hollow core stem positioned in said mechanism passage comprising a connecting member connecting said hollow core stem to said drill string drive mechanism, a first end extending into said mechanism passage and positioned for connection to said drill string, and a second end adapted for connection to a mud line assembly.

6. The drilling apparatus of claim 5 wherein said second end is adapted for connection to a mud line connector, wherein said mud line connector is rotatable relative to said mud line assembly, whereby said mud line connector rotates with said second end when said mud line connector is connected to said second end.

7. A drilling apparatus comprising:

a vertically extending tower supporting a main body, said main body defining a main body passage extending therethough, wherein said main body comprises a drill string drive mechanism rotatably positioned within the main body passage wherein said mechanism defines a mechanism passage through the main body passage, wherein said mechanism passage is adapted to allow travel of drill pipe therethrough, wherein the mechanism is adapted to rotate in relation to the main body, wherein said mechanism is adapted to be driven by a motor, and wherein said mechanism is adapted to drive a drill string;

a hollow core stem positioned in the mechanism passage comprising a connecting member connecting said hollow core stem to the drive mechanism, a first end extending into the mechanism passage and positioned for connection to said drill string, and a second end adapted for connection to a mud line assembly;

a drawworks positioned to provide vertical movement of said main body; and a pipe stand.

8. A well drilling apparatus comprising:

a top drive assembly comprising a main body defining a main body passage extending therethrough, and a drive mechanism defining a drive mechanism passage through the main body passage, wherein said drive mechanism is rotatably positioned within said main body passage, and wherein said drive mechanism passage is adapted to allow travel of drill pipe therethrough;

a drilling fluid line assembly comprising a drilling fluid line connector; and a core stem defining a core stem passage therethrough, said core stem comprising a first end extending into the drive mechanism passage and a second end, wherein said core stem is removably positioned within said drive mechanism passage, wherein said first end is adapted for connection to a drill string and said second end is adapted for connection to the drilling fluid line connector, wherein said core stem is adapted to be rotated by said drive mechanism, and wherein said core stem is adapted to drive rotation of said drill string.

9. The well drilling apparatus of claim 8 wherein said fluid line connector is rotatable relative to said drilling fluid line assembly, whereby said fluid line connector rotates with said second end when said fluid line connector is connected to said second end.

10. A method for drilling a well, said method comprising:

(a) passing a drill pipe through a mechanism passage of a drilling apparatus, wherein said apparatus comprises a main body defining a main body passage extending therethrough, a drill string drive mechanism rotatably positioned within the main body passage wherein said mechanism defines a mechanism passage through the main body passage, wherein said mechanism passage is adapted to allow travel of said drill pipe therethrough, wherein the mechanism is adapted to rotate in relation to the main body, wherein said mechanism is adapted to be driven by a motor, and wherein said mechanism is adapted to drive a drill string;

(b) connecting the drill pipe to said drill string;

(c) connecting the drill string to the drive mechanism;

(d) rotating the drill string into the well hole; and (e) disconnecting the drill string and the drive mechanism.

11. A method of disconnecting a portion from a drill string comprising at least two portions, wherein said drill string is positioned in a well bore, said method comprising the steps of:

(a) removing said portion of the drill string from the bore;

(b) passing the portion through a passage extending through a top drive; and (c) disconnecting the portion from the drill string.

12. A method for adding drill pipe to a drill string, said method comprising the steps of:

(a) passing said drill pipe to be added through a passage extending through a top drive; and (b) connecting the drill pipe to the drill string.

* * * * *